US006209931B1

(12) United States Patent
Von Stoutenborough et al.

(10) Patent No.: US 6,209,931 B1
(45) Date of Patent: Apr. 3, 2001

(54) MULTI-POINT DOOR LOCKING SYSTEM

(75) Inventors: Eric Von Stoutenborough, Winnebago; Stephen Mark Purcell, Loves Park; Michael David Smith, Winnebago; Thomas Michael Wright, Rockford, all of IL (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/255,297

(22) Filed: Feb. 22, 1999

(51) Int. Cl.[7] ..... E05C 1/06; E05C 1/12
(52) U.S. Cl. ..... 292/160
(58) Field of Search ..... 292/332, 333, 292/336.3, 39, 34, 36, 160, 341.15

(56) References Cited

U.S. PATENT DOCUMENTS

| | | | | |
|---|---|---|---|---|
| Re. 26,677 | * | 10/1969 | Russel et al. | 292/34 |
| 1,168,524 | * | 1/1916 | Lurie | 292/341.15 |
| 1,525,303 | * | 2/1925 | Lanphere | 292/333 |
| 2,012,693 | * | 8/1935 | Rieback | 292/341.15 |
| 2,218,183 | * | 10/1940 | Springer | 292/341.15 |
| 3,242,706 | * | 3/1966 | Check | 292/34 |
| 3,672,714 | * | 6/1972 | Schultz | 292/34 |
| 3,998,483 | * | 12/1976 | Yan | 292/341.15 |
| 4,548,432 | | 10/1985 | Bengtsson . | |
| 4,671,089 | | 6/1987 | Fleming et al. . | |
| 4,671,549 | * | 6/1987 | Marotto et al. | 292/333 |
| 4,754,624 | | 7/1988 | Fleming et al. . | |
| 4,784,417 | | 11/1988 | Fleming et al. . | |
| 4,876,866 | | 10/1989 | Fleming et al. . | |
| 4,890,870 | * | 1/1990 | Miron | 292/333 |
| 4,896,905 | | 1/1990 | Lehr et al. . | |
| 4,950,005 | * | 8/1990 | Cudd | 292/333 |
| 4,964,660 | | 10/1990 | Prevot et al. . | |
| 4,986,576 | | 1/1991 | Anderson . | |
| 5,058,938 | | 10/1991 | Döring et al. . | |
| 5,171,047 | | 12/1992 | Korb et al. . | |
| 5,192,097 | * | 3/1993 | Su | 292/165 |
| 5,197,771 | | 3/1993 | Kaup et al. . | |

(List continued on next page.)

OTHER PUBLICATIONS

Materials relating to a product understood to be commercially available from AB Essve Produkter, Kista, SE; 1 page (materials prepared by the Applicants in or about Jul. 1999). The written description provides the Applicants' present understanding of the manner of operation of the product.

Materials relating to a product understood to be commercially available from Fuller Company, Bethlehem, PA; 2 pages (materials prepared by the Applicants in or about Jul. 1999). The written description provides the Applicants' present understanding of the manner of operation of the product.

Materials relating to a product understood to be commercially available from G–U Hardware Incorporated, Newport News, Virginia; 2 pages (materials prepared by the Applicants in or about Jul. 1999). The written description provides the Applicants' present understanding of the manner of operation of the product.

(List continued on next page.)

*Primary Examiner*—Lynne H. Browne
*Assistant Examiner*—John B. Walsh
(74) *Attorney, Agent, or Firm*—Foley & Lardner

(57) ABSTRACT

A multi-point door lock unit is disclosed. In one preferred form the door lock is for use with a hinged or swinging door. The door lock unit has a latch, a deadbolt, and extension bolts extendable away from the door. The door lock may be used with a double door entry whereby one door is an active door having the lock unit and a second door is a passive door having a passive lock unit. Further, the door lock unit has an activation button that prevents extension of the deadbolt and the extension bolts unless the activation button is depressed.

79 Claims, 12 Drawing Sheets

U.S. PATENT DOCUMENTS

| | | | | |
|---|---|---|---|---|
| 5,290,077 | | 3/1994 | Fleming . | |
| 5,301,525 | | 4/1994 | Döring . | |
| 5,373,716 | | 12/1994 | MacNeil et al. . | |
| 5,382,060 | | 1/1995 | O'Toole et al. . | |
| 5,388,875 | | 2/1995 | Fleming . | |
| 5,495,731 | | 3/1996 | Riznik . | |
| 5,498,038 | | 3/1996 | Simon et al. . | |
| 5,524,941 | | 6/1996 | Fleming . | |
| 5,524,942 | | 6/1996 | Fleming . | |
| 5,702,134 | | 12/1997 | Hsieh . | |
| 5,722,704 | | 3/1998 | Chaput et al. . | |
| 5,813,255 | * | 9/1998 | Tell, III et al. | 292/34 |
| 6,050,115 | | 4/2000 | Schröter et al. | 70/107 |

OTHER PUBLICATIONS

Materials relating to a product understood to be commercially available from Trimco Finish, Inc., Santa Ana, CA; 1 page (materials prepared by the Applicants in or about Jul. 1999). The written description provides the Applicants' present understanding of the manner of operation of the product.

Materials relating to a product understood to be commercially available from W&F Manufacturing, Inc., Glendale, CA; 2 pages (materials prepared by the Applicants in or about Jul. 1999). The written description provides the Applicants' present understanding of the manner of operation of the product.

Materials relating to a product understood to be commercially available from Winkhaus Technik GmbH & Co. KG, Meiningen, Germany; 2 pages (materials prepared by the Applicants in or about Jul. 1999). The written description provides the Applicants' present understanding of the manner of operation of the product.

Materials relating to a (auto–lock) product understood to be commercially available from Carl Fuhr GmbH & Co., Heiligenhaus, DE; 2 pages (materials prepared by the Applicants in or about Jul. 1999). The written description provides the Applicants' present understanding of the manner of operation of the product.

Materials relating to a (manually operated) product understood to be commercially available from Carl Fuhr GmbH & Co., Heiligenhaus, DE; 2 pages (materials prepared by the Applicants in or about Jul. 1999). The written description provides the Applicants' present understanding of the manner of operation of the product.

"Technology in Motion;" Order No. 49470—Date: Nov. 1995; Mayer & Co. Beschläge GmbH (MACO).

"MACO Door Locks Functional and Secure;" Order No. 49452–13 Date: Feb. 1997; Mayer & Co. Beschläge GmbH (MACO).

"The New Breed of Security;" G–U Hardware Incorporated; Newport News, Virginia, undated.

"Frühjahrsaktion 98 Für Schreiner;" SÜD–Metall Beschläge Die Freude Schenken.

"BKS OCTUS Innovation '98," undated, pp. 8.

"Guard your castle Asgard & Midgard—multi–point locks;" Fix AB; Göteborg, Sweden; undated.

"Handbook for Multi–Point Door Hardware There's Beauty In Security;" G–U Hardware Incorporated; Newport News, Virginia; undated.

"Hardware Systems Patio Doors;" copyright 1993 Truth Hardware; Owatonna, MN.

"Fuhr Multisafe Security door bolt system" (bearing a label "Hardware Technologies Ltd." (HTL) "Fort Atkinson, WI") (bearing a mark "GB/MI/10 89").

"Fuhr Multisafe; 856 Lever operated door bolt;" (bearing a mark "BBA No. 1141") (bearing a label "Hardware Technologies Ltd." (HTL) "Fort Atkinson, WI"); Carl FUHR GmbH & Co; undated.

"Winkhaus STV High Security Door Locking Systems;" (bearing the mark "Druck–Nr. GB 50126/G") Winkhaus Technik GmbH & Co. KG; undated.

"news 'n' Facts Winkhaus STV AV Automatische Sicherheits—Tür–Verriegelung," Winkhaus STV; undated.

"STV Sicherheits–Tür–Verriegelung;" (bearing the mark "Druck–Nr. 44126/G") Winkhaus STV GmbH & Co. KG; undated.

"Fuhr Multisafe 855 Sicherheit rund ums Haus" (bearing the mark "BG–PRÜFZERT"); undated.

"Fuhr Multisafe 856 Verriegelungs–antrieb über Drücker;" Carl Fuhr GmbH & Co; undated.

"Fuhr Multisafe 855 Erhöhte Einbruchhemmung rund ums Haus;" (bearing the mark "BG–Prüfzert"); undated.

"Fuhr Multisafe 855, 856 Einbruchhemmende Türen rund ums Haus;" (bearing the mark "BG–PRÜFZERT") (bearing the mark "Werbepurtner Huth Duisburg/DF/7/1–97").

* cited by examiner

FIG. 9
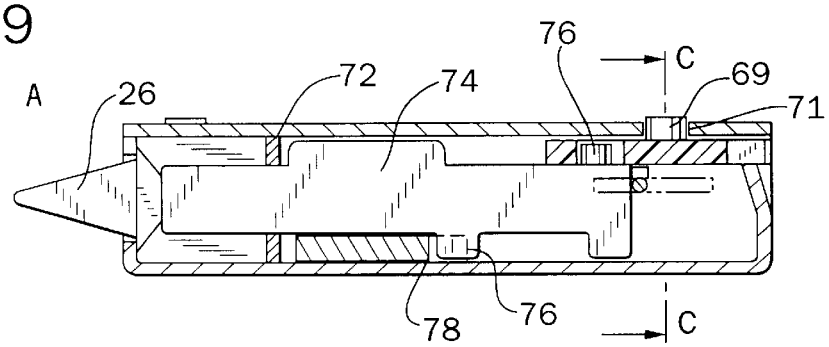
FIG. 10
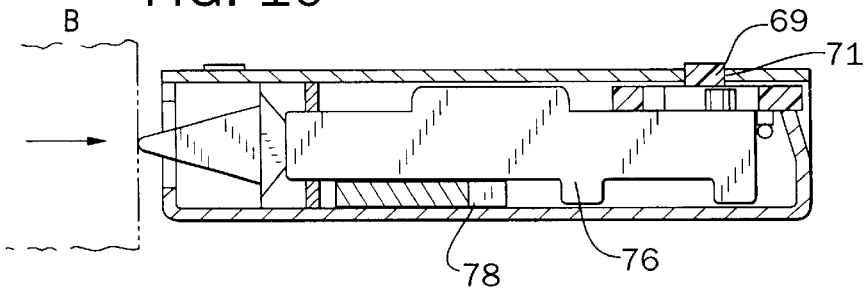
FIG. 11
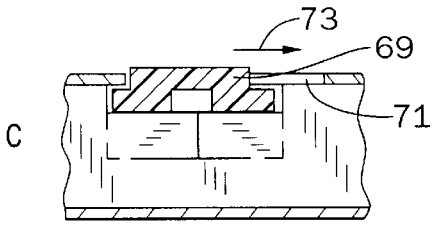
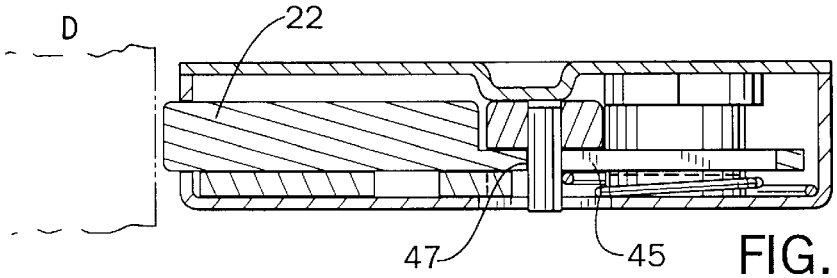
FIG. 12
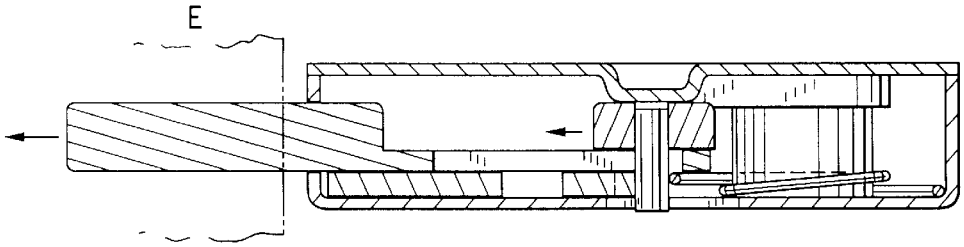
FIG. 13

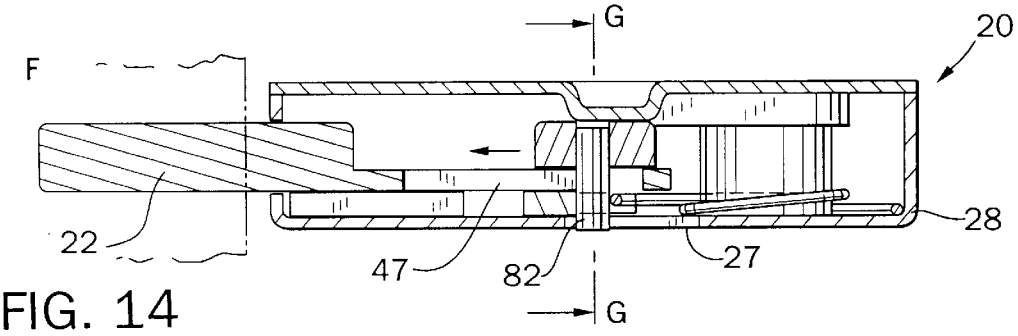
FIG. 14
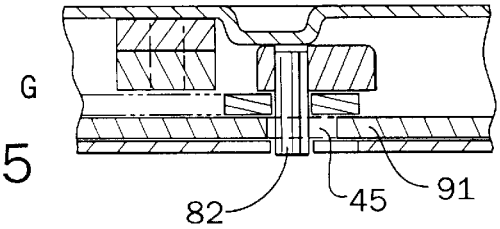
FIG. 15
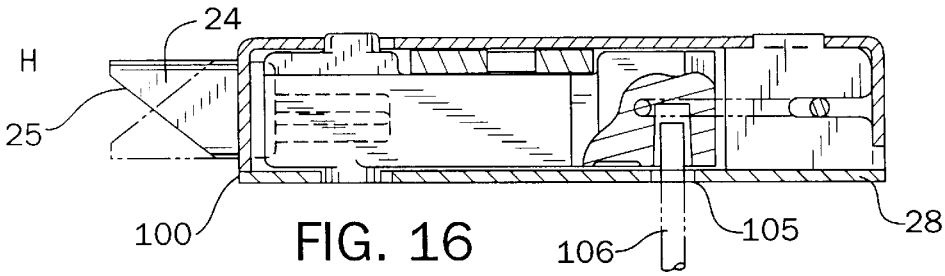
FIG. 16
FIG. 17
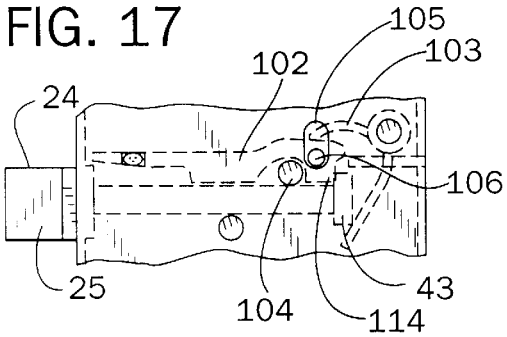
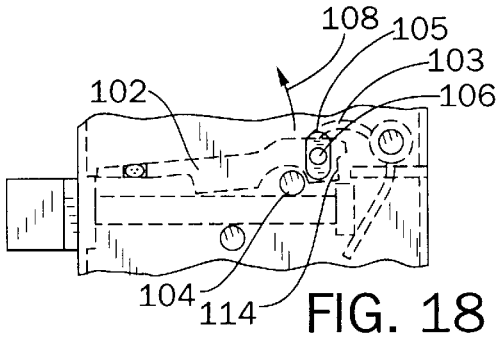
FIG. 18
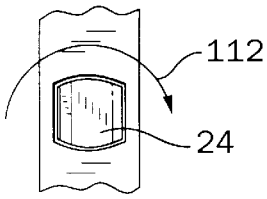
FIG. 19
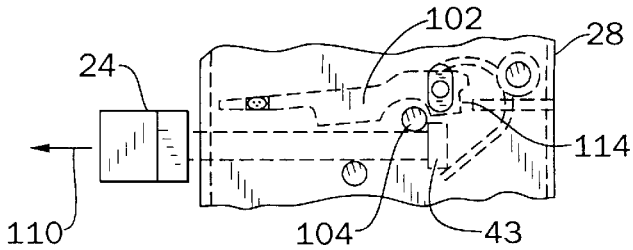
FIG. 20

MULTI-POINT DOOR LOCKING SYSTEM

FIELD OF THE INVENTION

The present invention relates to a multi-point door locking system.

BACKGROUND OF THE INVENTION

It is known to use multi-point door locks in sliding or french doors to provide secure closure and locking. In configuring a multi-point door lock there are a number of design considerations that must be made such that the door lock is easily manufactured, easily installed, functionally and aesthetically appealing, and secure.

A main feature of a typical conventional multi-point door lock is that the door lock has more than one latch or bolt to engage a door frame. Plural latches or bolts create a lock that is substantially more difficult to overcome in a forcible entry than a single deadbolt and latch. Thus, it is desirable, for example, in a french door to have three bolts and a latch. A first bolt and latch engage with a second door. A second and third bolt engage the upper and lower portions of the door frame, respectively. Such door locks do not permit the addition of the second or third bolts or latches to the central locking unit. Further, such multi-point door locks are not adaptable to accommodate doors of various heights. Further still, such multi-point door locks are configured to be used with only one door type. For example, a conventional multi-point door lock may only have the option of allowing the second and third bolt or latch mechanisms to run along an edge of the door, even when it may be desirable to have the mechanisms fully concealed within the door itself.

Conventional multi-point door locks may allow the second and third bolts or latches, which extend out the top and bottom of the door, to be extended even when the door is open. Therefore, if the door is slammed shut while the bolts are extended, the bolts may cause damage to the door, the door frame, or a door frame molding. Furthermore, such conventional multi-point door locks typically require extension of all the bolts or latches according to a specific sequence without allowing them to be extended independently of one another.

Moreover, such conventional multi-point door locks are not easily reconfigurable for use as left handed or right handed doors. Furthermore, such conventional multi-point door locks require that a user must rotate the latch drive handle more than 45 degrees in order to fully engage or disengage the bolts.

Accordingly, it would be advantageous to provide for a multi-point door lock system having multiple bolts or latches designed to engage a door or a door frame. It would also be advantageous to provide for a multi-point door lock having a standard deadbolt and extension bolts or shoot bolts extending through the door. Further still, it would be advantageous to have a multi-point door lock with shoot bolts or extension bolts that extend either along the front edge of the door or through the interior of the door. Thus, it would be advantageous to have such a mechanism that is easily configurable for a variety of door designs.

It would further be advantageous to provide for a multi-point door lock that has an activation button that allows actuation of at least one of the extension bolts or shoot bolts and the deadbolt when the activation button is depressed. Further, it would be desirable to have a multi-point door lock system in which the deadbolt may be extended independently of extension of the shoot bolts or extension bolts.

Further still, it would be desirable to have a multi-point door lock system in which the extended extension bolts are prevented from retraction when the deadbolt is extended.

It would further be advantageous to provide for a multi-point door lock system that is easily reconfigurable for one of a left hand door and a right hand door. It would further be advantageous to provide for a multi-point door lock in which the door lock handle actuates the door latch and provides a positive indication of when at least one extension bolt is extended. It would further be advantageous to provide for a multi-point door lock system such that the deadbolt and extension bolts move linearly at least one inch, thereby creating a more structurally sound locking system. It would further be advantageous to provide for a multi-point door lock system having fewer parts, especially fewer springs, creating an easily manufactured door lock.

It would be desirable to provide for a multi-point door lock incorporating any one or more of these advantageous features.

SUMMARY OF THE INVENTION

The present invention relates to a locking system. The locking system includes a base lock member moveable between a first position and a second position. The locking system further includes a first input device and an activation device. The locking system has a base lock member that is moveable between a first position and a second position in response to actuation of the first input device and the base lock member is prevented from moving from a first position to a second position when the activation device is not activated.

The present invention also relates to a locking system. The locking system includes a base lock member that is moveable between an open position and a fully locked position. The locking system also includes at least one secondary lock member that is moveable between an open position and a fully locked position and a first input device. The first input device is adapted to coact with at least one of the base lock member and the at least one secondary lock member. Movement of the base lock member to a fully locked position is selectively and sequentially independent of the movement of the at least one secondary lock member to the fully locked position.

The present invention further relates to a door lock assembly for use in locking a door. The door lock assembly includes a housing shaped to be inserted into an aperture in a door. The door lock assembly further includes a latch extendable from the housing, a first lock member extendable from the housing, and a first input device mounted adjacent the housing and coacting with the first lock member, the first input device affecting movement of the first lock member. The door lock assembly further includes at least one second lock member moveable relative to the housing, a second input device mounted adjacent the housing and configured to selectively actuate one of the at least one second lock member, adjacent the latch, and the at least one second lock member and the latch, and an activation device that allows actuation of one of the first lock member independent of the at least one second lock member, and the first lock member and the at least one second lock member independent of each other, when the activation device is activated.

The present invention still further relates to a lock assembly for securing a door to a door frame. The door has a top edge, a bottom edge opposite the top edge, a first edge and a second edge opposite the first edge. The door is movably coupled to the frame. The lock assembly includes a housing shaped to be inserted into an aperture in the door. A deadbolt is moveable through a deadbolt aperture in the housing, the deadbolt aperture is located along the first side edge of the door. A thumbturn is rotatably mounted adjacent the mortise housing and coacts with the deadbolt. The thumbturn affects movement of the deadbolt. A first lock member is moveable relative to the housing and a second lock member is also moveable relative to the housing. An activation device allows actuation of one of the first and second lock members, the first and second lock members and the deadbolt independent of each other, and the first and second lock members and the deadbolt dependent with each other when the activation device is activated.

The present invention still further relates to a lock assembly for securing a door to a door frame. The door has a first edge and a second edge opposite the first edge. The door is movably coupled to the fame. The lock assembly includes a housing shaped to be inserted into an aperture in the door. A latch is moveable through a latch aperture in the housing, the latch aperture being located along the first edge of the door. A deadbolt is moveable through a deadbolt aperture in the housing, the deadbolt aperture being located along the first edge of the door. A first input device is mounted adjacent the housing and coacts with the deadbolt, the first input device affecting movement of the deadbolt. At least one lock member is moveable within the housing. A second input device is rotatably mounted adjacent the housing and is configured to selectively actuate the at least one lock member, the latch, and the at least one lock member and the latch. The deadbolt and the at least one lock member may be selectively extended independently of one another.

The present invention still further relates to a lock assembly for securing a door to a door frame, the door has a first edge and a second edge opposite the first edge. The door is movably coupled to the frame. The lock assembly includes a housing shaped to be inserted into an aperture in the door. A latch is moveable through a latch aperture in the housing, the latch aperture being located along the first edge of the door. A deadbolt is moveable through a deadbolt aperture in the housing, the deadbolt aperture being located along the first edge of the door. A first input device is rotatably mounted adjacent the housing and coacting with the deadbolt. The first input device affecting movement of the deadbolt. A second input device, mounted adjacent the mortise housing is configured to selectively actuate the latch. An activation button, allows actuation of the deadbolt when the activation device is activated.

The present invention still further relates to a method of multi-point locking a door in a door frame. The method includes closing the door such that an activation device is activated. The method further includes releasing a first lock member from a held position, caused by interaction of the activation button with a stop. The method further includes extending the first lock member, releasing the secondary lock members from a held position caused by interaction of the activation button with a stop and extending the secondary lock members.

The present invention still further relates to a method of multi-point locking a double door in a door frame. The double door includes a passive door having a passive lock and an active door having an active lock. The method includes closing the passive door and extending lock members of the passive door. The method further includes opening a first lock member aperture in the passive lock and closing the active door such that an activation device is activated. The method further includes releasing the first lock member from a held position, caused by interaction of the activation button with a moveable stop, extending the first lock member, releasing the secondary lock members of the active door from a held position, and extending the secondary lock members of the active door.

The present invention still further relates to a lock assembly for securing a door in a door frame. The door has a first edge and a second edge opposite the first edge, the door is movably coupled to the frame. The lock assembly includes a housing shaped to be inserted into an aperture in the door and a faceplate coupled to the first edge of the door. A latch is moveable through a latch aperture in the housing, the latch aperture being located along the first edge of the door. A deadbolt is moveable through a deadbolt aperture in the housing, the deadbolt aperture being located along the first edge of the door. A thumbturn is rotatably mounted adjacent the mortise housing and coupled to the deadbolt, the thumbturn affecting movement of the deadbolt. At least one secondary lock member is moveable within the housing and a drive is rotatably mounted to the housing and configured to selectively actuate the at least one secondary lock member and the latch. The improvement of the invention includes, an activation button that allows actuation of one of the at least one secondary lock members, the deadbolt, and the at least one secondary lock member and the deadbolt, when the activation button is depressed.

The present invention still further relates to a door lock assembly for securing a door in a door frame. The door lock assembly includes a housing shaped to be inserted into an aperture in the door. A latch is extendable from the housing and a first lock member is extendable from the housing. A second lock member is moveable relative to the housing. A drive means selectively actuates one of the first lock member, the second lock member, and the first lock member and the second lock member. A lock out means prevents actuation of one of the first lock member independent of the second lock member, and the first lock member and the first lock member and the second lock member independent of each other, when the lock out means is not activated.

The present invention still further relates to a locking system including a base lock member moveable between an open position and a fully locked position, and at least one secondary lock member moveable between an open position and a fully locked position. The first input device is adapted to coact with at least one of the base lock member and the at least one secondary lock member. Movement of the base lock member is selectively and sequentially independent of movement of the at least one secondary lock member. The at least one secondary lock member is prevented from substantial movement when the base lock member and the at least one secondary lock member are in their respective fully locked positions.

BRIEF DESCRIPTION OF THE DRAWINGS

FIG. 9 is a cross sectional view of the multi-point door lock mortise unit taken across line A—A of FIG. 5.

FIG. 10 is a cross sectional view of the multi-point door lock unit taken across line B—B of FIG. 6.

FIG. 11 is a cross sectional view of the multi-point door lock unit taken across line C—C of FIG. 9.

FIG. 12 is a cross sectional view of the multi-point door lock mortise unit taken across line D—D of FIG. 6.

FIG. 13 is a cross sectional view of the multi-point door lock mortise unit taken across line E—E of FIG. 7.

FIG. 14 is a cross sectional view of the multi-point door lock mortise unit taken across line F—F of FIG. 8.

FIG. 15 is a partial cross sectional view of the multi-point door lock unit taken across line G—G of FIG. 13.

FIG. 16 is a cross sectional view of the multi-point door lock unit taken across line H—H of FIG. 5.

FIG. 17 is a partial cut away view of the latch reversal mechanism of the multi-point door lock unit.

FIG. 18 is a partial cut away view of the latch reversal unit of FIG. 17 depicting the reversal mechanism being activated.

FIG. 19 depicts a partial cut away view of the latch showing rotation of the latch provided by the latch reversal mechanism.

FIG. 20 is a partial cut away view of the latch reversal mechanism of FIG. 17 showing the latch being extended.

DESCRIPTION OF THE PREFERRED EMBODIMENTS

Figure 1:
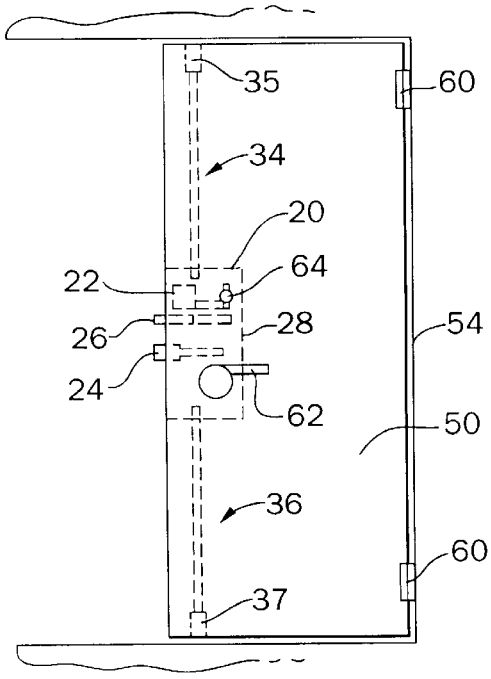
FIG. 1 is an elevational view of a door having a multi-point door lock system.
Figure 2:
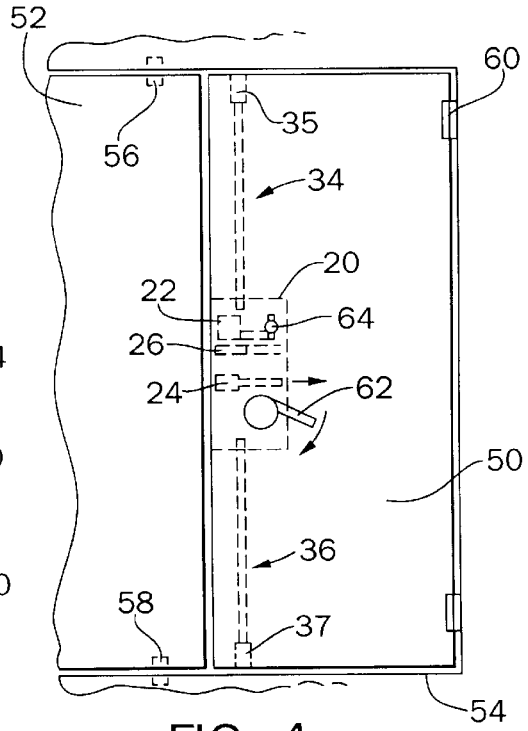
FIG. 2 is an elevational view of the door depicted in FIG. 1 showing a second door in the closed position.
Figure 3:
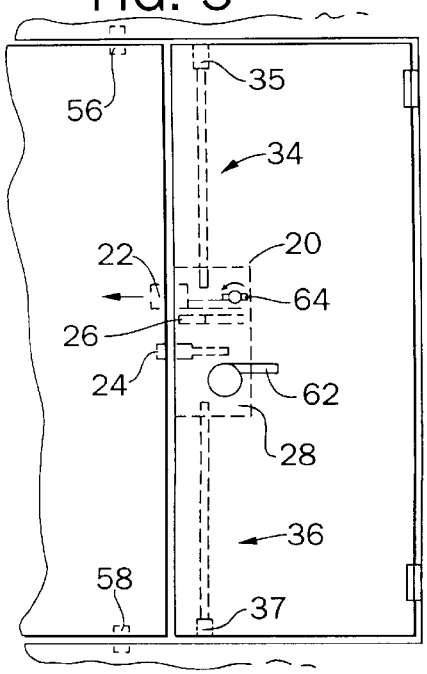
FIG. 3 is an elevational view of the doors of FIG. 2 having a deadbolt moving into a locked position.
Figure 4:
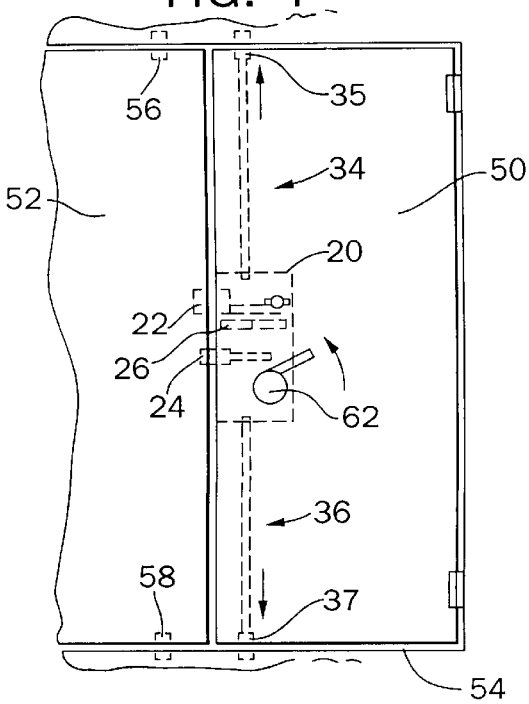
FIG. 4 is an elevational view of the doors of FIG. 3 showing the deadbolt locked and the extension bolts moving into a locked position.

Referring to FIG. 1, a door lock mortise unit 20 is shown. Mortise unit 20 is embedded in (or otherwise associated with) a primary door 50. Primary door 50 is typically used for ingress and egress whereas a secondary door 52, depicted in FIGS. 2–4 is typically latched to a door frame 54 (and used for access only as needed). (Alternatively, door 50 may be mounted singly in a door frame.) Doors 50 and 52 are rotatably coupled to door frame 54 by a set of hinges 60 so that when primary door 50 and secondary door 52 are in an unlatched condition they may swing freely from an open position to a closed position. (Alternatively, doors 50 and 52 each may be in a sliding door arrangement whereby doors 50 and 52 slide along a track attached to door frame 54, from an open to a closed position.) Latches 56 and 58 fix door 52 from movement when latches 56 and 58 are extended and engaged with door frame 54.

Referring again to FIG. 1, mortise lock 20 includes a base lock member shown as deadbolt 22, a latch 24, an activation device shown as activation button 26, a housing 28, a first input device shown as thumbturn handle 64, a second input device shown as handle 62, an upper secondary lock member shown as upper extension bolt assembly 34, and a lower secondary lock member shown as lower extension bolt assembly 36. Deadbolt 22 is actuated by rotation of thumbturn handle 64 (e.g. an input device). Retraction of latch 24 into housing 28 is caused by rotation of handle 62 (e.g. an input device).

In operation, secondary door 52 would be closed, as depicted in FIG. 2, with latches 56 and 58 engaged with door frame 54. Primary door 50 is then closed. To cause locking of door 50, an operator typically first turns thumbturn handle 64, in a counterclockwise direction, as depicted in FIG. 3, thereby extending deadbolt 22. Latch 24 is spring biased to cause latching engagement with secondary door 52. Next, an operator causes engagement of extension bolts 35 and 37 with door frame 54. (Alternatively, door 50 may have any of a variety of lock members such as extension bolts, latches, hooks, or other suitable locking members to engage door 52 or door frame 54.) Engagement of extension bolts 35 and 37 is caused by a counterclockwise rotation of handle 62, as depicted in FIG. 4. Once latch 24, deadbolt 22, and extension bolts 35 and 37 are engaged, doors 50 and 52 are in a fully locked state. Lock 20 also allows alternative sequences to be used to lock door 50. For example, an operator may first turn thumbturn handle 64, to extend deadbolt 22 and then lift handle 62 to extend extension bolts 35 and 37. Thus, deadbolt 22 and extension bolts 35 and 37 are extendably independent of one another. (Alternatively, the movement of deadbolt 22 and extension bolts 35 and 37 may be dependent on one another.) It should be noted that any lock members (e.g. both extension bolts 35 and 37 and deadbolt 22) may be any of a variety of types of locking members including, but not limited to flippers, hooks, and other suitable locking members (having any of a variety of locking actions, e.g. directions, orientations). For example, extension bolts may be configured to move laterally or horizontally and may be configured to engage a door or a door frame.

Figure 5:
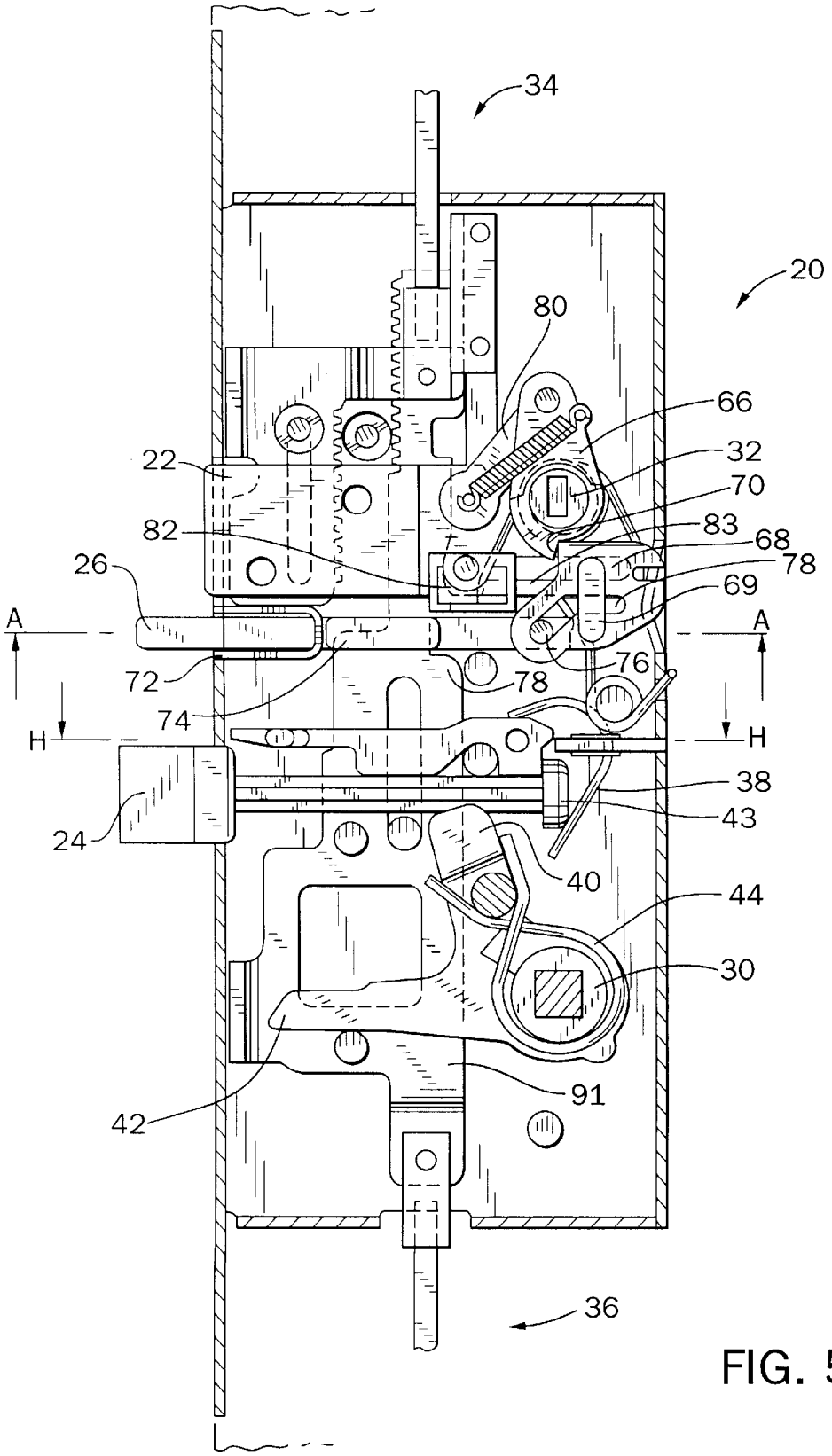
FIG. 5 is an elevational view of the multi-point door lock mortise unit of FIG. 1 having the cover plate removed and showing the mechanical mechanism of the door lock.
Figure 24:
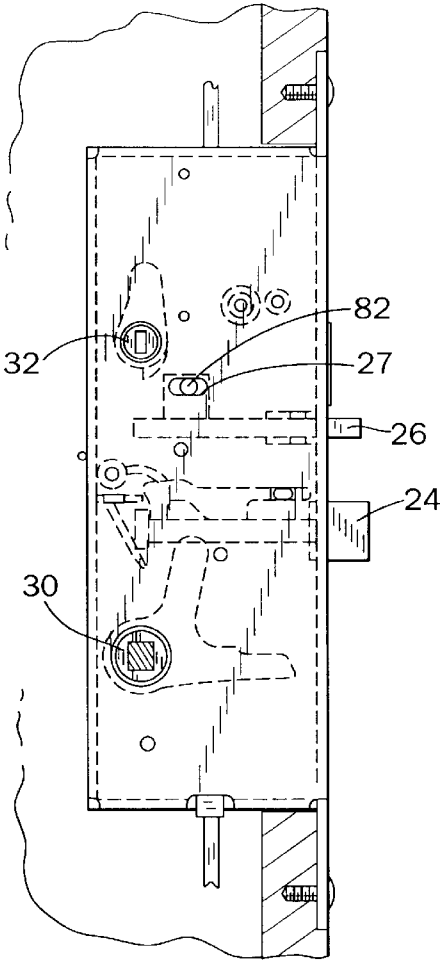
FIG. 24 is a side elevational view of the door lock unit showing the opposing side to that shown in FIG. 22.

Referring now to FIG. 5, mortise door lock unit 20 is depicted in the door open state, with latch 24 extended and activation button 26 also extended. Because activation button 26 is extended, both deadbolt 22 and extension bolt assemblies 34 and 36 cannot be extended. (Alternatively, activation button 26 may be configured to prevent movement or engagement of only one of deadbolt 22 and extension bolt assemblies 34 and 36.) Deadbolt 22 is actuated by rotation of thumbturn 32, thumbturn 32 being coupled to thumbturn handle 64 (depicted in FIG. 1). The extension of latch 24 is caused by a latch biasing spring 38. Therefore, latch biasing spring 38 causes latch 24 to be extended while a drive 30 (drive 30 is coupled to handle 62, as depicted in FIG. 1) is not being rotated in the clockwise direction. It should be noted that both drive 30 and thumbturn 32 extend through both sides of mortise unit 20 (see FIGS. 22 and 24). Therefore, rotational directions are reversed if operated from the opposing side. In a preferred embodiment, thumbturn 32 is coupled to a thumbturn handle 64 as depicted in FIGS. 1–4 on one side of the door and is coupled to a keyway on the opposite side of the door such that a key must be used to turn thumbturn 32. (Alternatively, keyways are interchangeable with thumbturn handle 64 and handle 62; also, thumbturn handle 64 may be any suitable handle and handle 62 may be a thumbturn handle or any other suitable handle.)

Latch 24 is preferably made from a polymeric material such as a plastic resin (e.g., DELRIN polyester resin or other polymers or composites) to provide a quieter latching action when latch 24 engages a strike plate situated on the edge of an opposing door or door frame. (Alternatively, latch 24 may be made from a metal or metal alloy and the strike plate may be made from a polymeric or metallic material.) The application of a plastic latch may also produce less wear on a strike plate. (According to a preferred embodiment, most of the components of the door lock assembly are made from metallic materials such as steel, and steel alloys, however is may be preferable to manufacture some of the components from polymeric materials and polymer composite materials to provide ease of manufacturing, lower manufacturing costs, required strength properties, required flexibility properties, and other desired properties.) As drive 30 is rotated clockwise to unlatch or retract latch 24, a drive spring 44 causes an opposing torque that returns an input arm 42 to a nominal position, as depicted in FIG. 5, after the latch retracting torque is released from drive 30. Further, during the latching action, a strike plate attached to a second door or a door frame, causes latch 24 to retract into housing 28. Latch 24 is then forced into an aperture in the strike plate by a latch biasing spring 38.

Drive unit 30 is also used to extend upper extension bolt base assembly 34 and lower extension bolt base assembly 36. In one embodiment of the present invention extension bolt base assembly 34 is attached to an extension bolt 35 as depicted in FIGS. 1–4. Lower extension bolt base 36 is likewise coupled to an extension bolt 37.

In an alternative embodiment, thumbturn 32 may actuate both the extension bolt bases 34 and 36 as well as deadbolt 22.

Referring again to FIG. 5, mortise door lock unit 20 is depicted as with the door open position such that everything (e.g. all lock members) is in the fully unlocked position. Furthermore, activation button 26 is extended thereby preventing the extension of deadbolt 22 and extension bolt assemblies 34 and 36. Alternatively, activation button 26 may be configured to prevent movement of any combination of extension bolt base assemblies 34 and 36, handle 62, thumbturn 32, or deadbolt 22. Activation button 26 is free to move within an activation button housing 72. As activation button 26 is depressed into housing 28, activation button 26 moves into activation button housing 72 where it engages a push rod 74. (According to an alternative embodiment, activation button 26, activation button housing 72, and push rod 74 may be combined into a single integrated activation device.) As depicted in FIGS. 9 and 10, push rod 74 has a stop 76, extending therefrom, that is slidably engaged with a slot 78 on a slide plate 91. Therefore, as depicted in FIGS. 5 and 9 the interaction between stop 76 and slot 78 when activation button 26 is extended prevents slide plate 91 from substantially moving in the vertical direction. As activation button 26 is depressed, and push rod 74 causes stop 76 to slide out of slot 78, slide plate 91 will be freed for movement in the vertical direction. Therefore, it is possible to operate extension bolt assemblies 34 and 36 independent of the operation of deadbolt 22.

Figure 6:
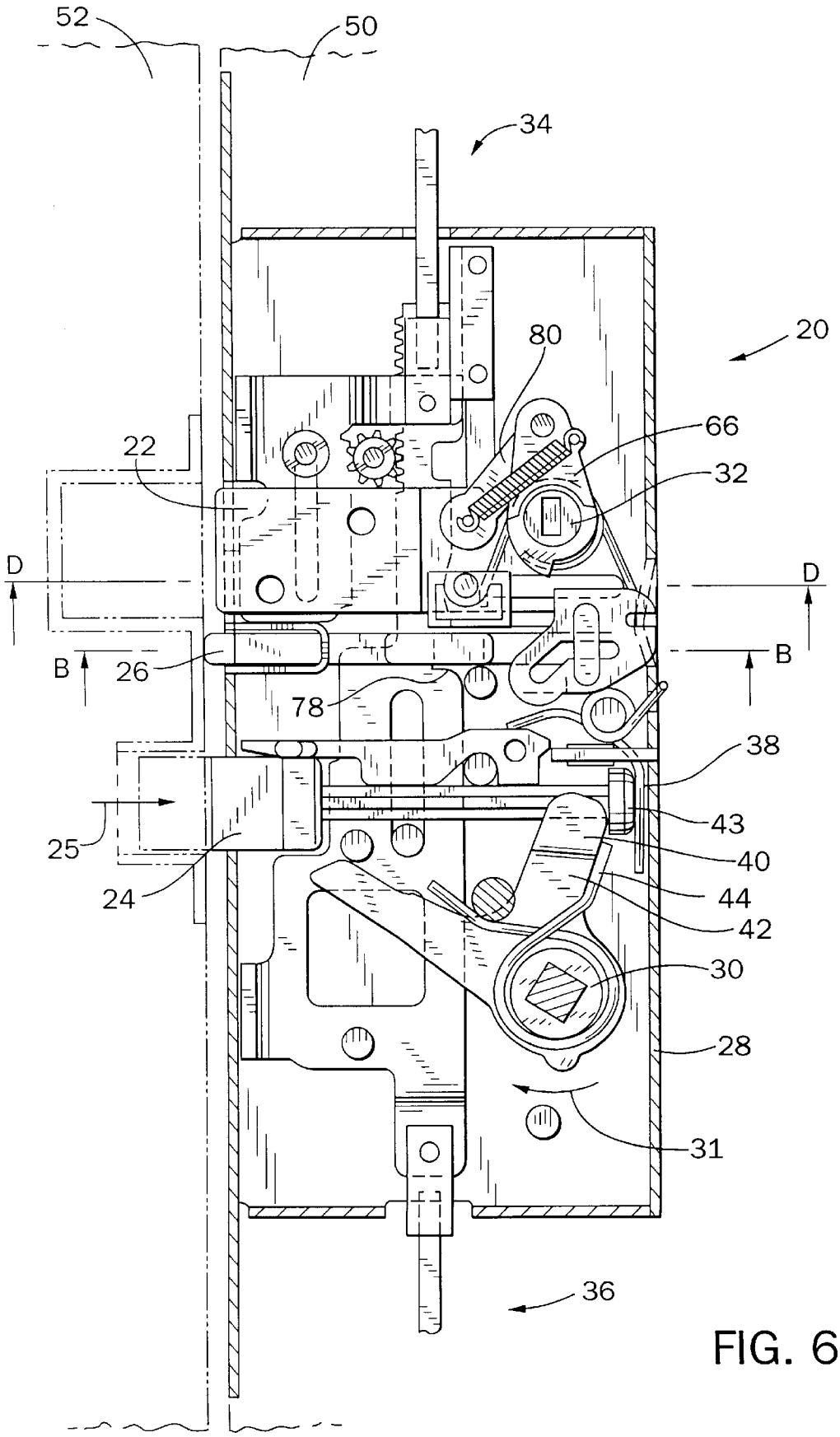
FIG. 6 is an elevational view of the multi-point door lock of FIG. 5 showing the deadbolt, the latch, and the extension bolts in a retracted position.

During normal operation, door 50 closes and latch 24 is extended into an opposing door or door frame, thereby latching door 50 in a closed position. When door 50 is in a closed position, activation button 26 engages the strike plate on the opposing door or door frame and is thereby depressed into housing 28. If an operator chooses to open door 50, handle 64 is rotated in the clockwise direction. Clockwise rotation of handle 64 rotates drive 30 in the clockwise direction causing a first end 40 of input arm 42 to engage latch stop 43, as depicted in FIG. 6, thereby pulling latch 24 into housing 28, as shown by arrow 25 in FIG. 6. (Alternatively, latch 24 may be configured to be actuated by thumbturn 32.) FIG. 6 depicts mortise lock unit 20 when door 50 is in the closed and unlocked position and drive unit 30 is turned to unlatch door 50 from door 52.

FIG. 5 depicts deadbolt 22 in the retracted state, that is deadbolt 22 is retracted into housing 28. In the position depicted in FIG. 5, deadbolt 22 is in a held position; that is an operator attempting to turn thumbturn 32 in order to cause deadbolt 22 to be extended is prevented from turning thumbturn 32 unless activation button 26 is depressed. Thumbturn handle 64, depicted in FIGS. 1–4, causes deadbolt 22 to be extended when thumbturn handle 64 is rotated in the counterclockwise direction. Thumbturn handle 64 is coupled to thumbturn 32. Consistent therewith, deadbolt 22 is retracted when thumbturn handle 64 is turned in the clockwise direction. As depicted in FIG. 5, thumbturn 32 is coupled to a thumbturn link 66. Thumbturn link 66 is designed to provide an extended moment arm for thumbturn 32 and to engage a thumbturn stop 68 at a thumbturn link engagement site 70. Alternatively, any number of suitable mechanisms may be used to provide movement to deadbolt 22, including, for example a system of gears or a system of links and gears.

As depicted in FIG. 5, thumbturn stop 68 prevents thumbturn 32 from being rotated in a counterclockwise direction to extend deadbolt 22. (Thumbturn stop 68 is but one exemplary embodiment of a stop mechanism that prevents deadbolt 22 from being extended; according to alternative embodiments, any number of alternative mechanisms may be employed to provide the function of thumbturn stop 68.) Therefore, to extend deadbolt 22, activation button 26 must first be depressed. As activation button 26 is depressed into housing 28, activation button 26 moves into activation button housing 72 where it engages a push rod 74. (Activation button 26 should not be considered limited to the "button" configuration disclosed, as other devices, mechanisms or linkages could be used to provide the function of activation button 26.) Push rod 74 has a pin 76 extending therefrom that is slidably engaged with a slot 78. As activation button 26 is depressed and push rod 74 causes pin 76 to ride in slot 78, thumbturn stop 68 is caused to move in a downward direction perpendicular to the direction of movement of push rod 74. Thumbturn stop 68 is constrained to move by a stop guide 69, as depicted in FIGS. 5, 9, and 11. (Alternatively, thumbturn stop 68 could be constrained by a pin, a series of pins, constrained to rotate about an axis, or constrained to move in any number of suitable ways.) Stop guide 69 is constrained to move in a slot 71 in housing 28, depicted in FIGS. 9, 11, and 22. Slot 71 and stop guide 69 constrains thumbturn stop 68 to move linearly in the direction shown by arrow 73 in FIG. 11. When thumbturn stop 68 has fully moved downward in the vertical direction, as constrained by the engagement of pin 76 and slot 78 and stop guide 69 and slot 71, thumbturn engagement extension 70 is released from engagement with thumbturn stop 68. (Alternatively, thumbturn stop 68 may be a variety of mechanisms including but not limited to a link that is rotatably mounted and actuated through coaction with activation button 26.) Therefore, thumbturn 32 may be rotated in the counterclockwise direction to extend deadbolt 22. Thumbturn link 66 is rotatably coupled with a second thumbturn link 80, that is rotatably coupled with deadbolt 22. Deadbolt 22 is constrained to move in a linear direction by pin guide 82. Pin guide 82 has a pin extending through pin guide 82 that rides in a slot 83.

As will be recognized, if deadbolt 22 is extended while door 52 is closed and door 50 is open, and door 50 is subsequently closed, deadbolt 22 will contact door 52 thereby causing damage to door 52 (or to the frame in a single-door application). It is thus important to note that because activation button 26 must be depressed before deadbolt 22 may be extended, deadbolt 22 may be extended only under certain conditions, for example, when the door is in a closed position and activation button 26 is depressed by the abutting second door or door frame or, when activation button 26 is intentionally depressed by an operator. Therefore, the utilization of activation button 26 helps prevent closure (i.e. accidental slamming) of an "open" door, such as the type shown by door 50, as depicted in FIGS. 1–4, when deadbolt 22 is extended.

Furthermore, it is important to note that extension of deadbolt 22 and extension assemblies 34 and 36 are independent of one another, providing an operator with full selectivity of extending the base lock member or the secondary lock members. In other words, deadbolt 22 may be extended (fully) while extension assemblies 34 and 36 are retracted, or extension assemblies 34 and 36 may be fully extended while deadbolt 22 is retracted.

Referring now to FIG. 6, mortise lock unit 20 is depicted in the door closed position having deadbolt 22 and extension bolt assemblies 34 and 36 in the unlocked state, and having latch 24 retracted. As depicted by directional arrow 31, drive unit 30 is rotated in the clockwise position to engage first end 40 of input arm 42 with latch stop 43. As depicted, drive 30 is rotated so that first end 40 engages latch stop 43 causing latch 24 to move in the horizontal direction as depicted by directional arrow 25. Also, as drive 30 is rotated in the clockwise direction, drive spring 44 flexes which tends to put a counterclockwise torque on drive 30 so that when an operator induced torque is released from drive 30, input arm 42 returns to the nominal position, depicted in FIG. 5. Further, as latch 24 moves in the direction of arrow 25, latch spring 38 is caused to flex thereby storing potential energy which is used to return latch 24 to an extended position (shown in phantom lines).

Figure 7:
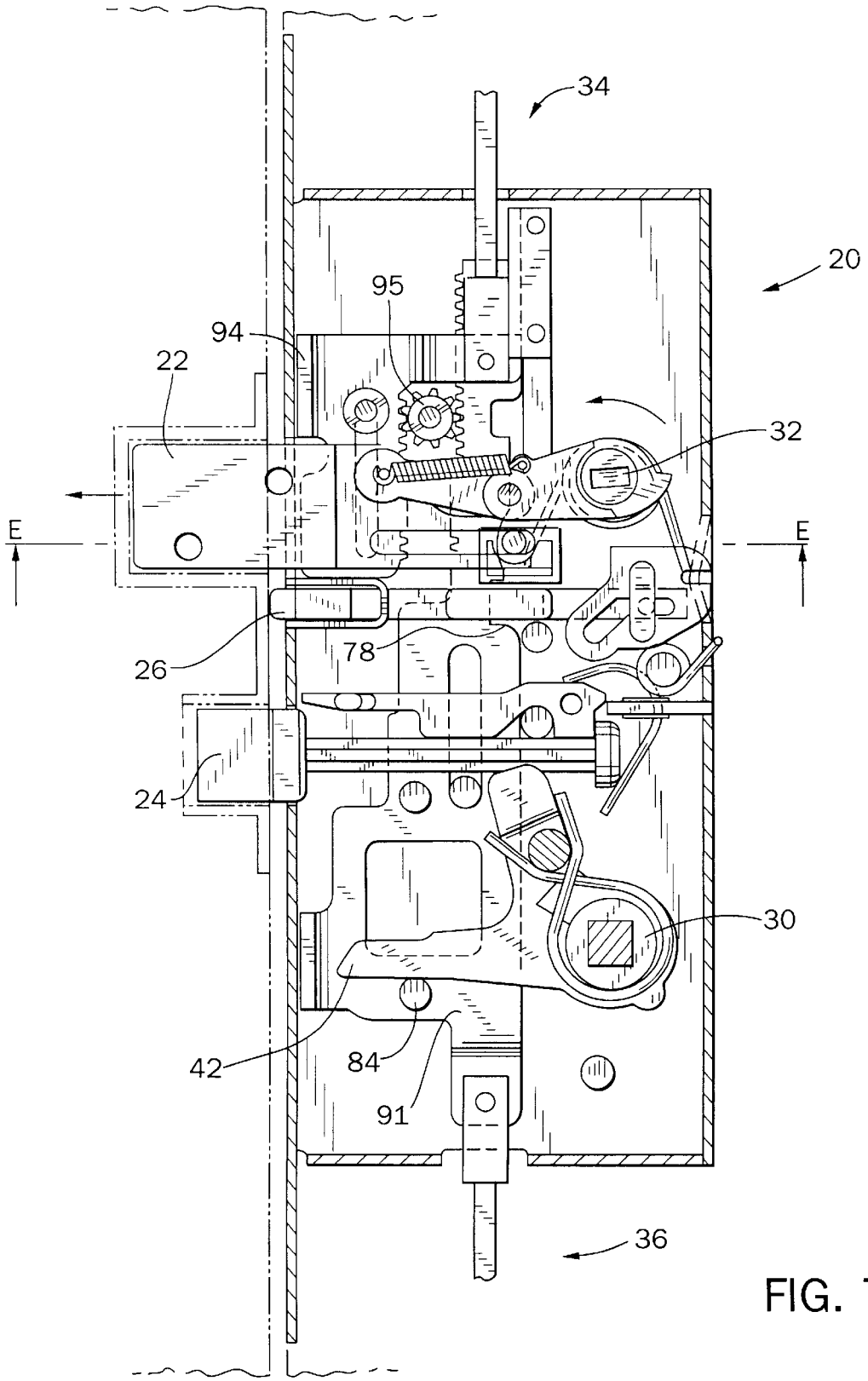
FIG. 7 is an elevational view of the multi-point door lock of FIG. 6 having the deadbolt and the latch in an extended position and the extension bolts in a retracted position.
Figure 8:
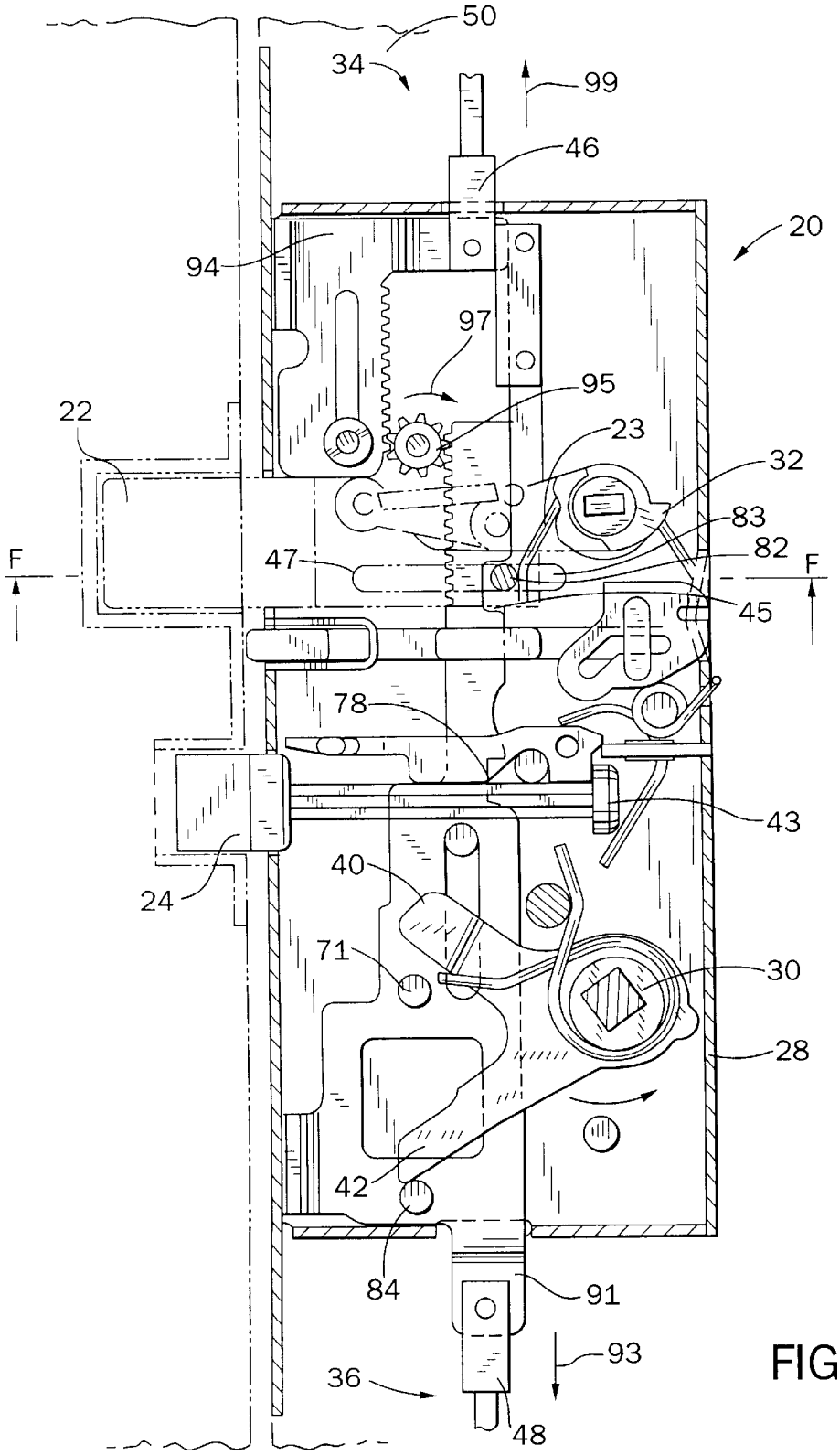
FIG. 8 is the multi-point door lock of FIG. 7 having the latch, the deadbolt, and the extension bolts in the extended position.

Referring now to FIG. 7, mortise lock unit 20 is depicted in a door closed position having deadbolt 22 extended and having extension bolt assemblies 34 and 36 in an unlocked or retracted state. In the position depicted in FIG. 7, deadbolt 22 may be freely locked and unlocked by turning thumbturn 32. Furthermore, latch 24 may be freely retracted by rotating drive 30 in a clockwise direction. Because activation button 26 is depressed, extension bolt assemblies 34 and 36 are also free to move by rotation of drive unit 30 in the counterclockwise direction. As drive 30 is rotated in the counterclockwise direction input arm 42 engages a pin 84 that extends from slide plate 91. The force of input arm 42 on pin 84 causes slide plate 91 to move in the vertical downward direction (as indicated by arrow 93 depicted in FIG. 8). As depicted in FIG. 8, downward movement of slide plate 91 causes a pinion gear 95 to rotate in the counterclockwise direction as indicated by arrow 97. As pinion gear 95 rotates in the clockwise direction, an upper slide plate 94 is caused to move in the vertical upward direction indicated by arrow 99, thereby reversing the motion supplied by plate 91. (Alternatively, other motion-reversing devices, mechanisms or linkages may be used, such as a suitably configured series of gears, links, or levers, or any other suitable combination of mechanical elements.) When slide plate 91 has moved to the fully locked position, as depicted in FIG. 8, pin 82 moves into a slot 45 on slide plate 91. (Although slide plate 91 is depicted as a sliding plate, other mechanisms, such as rotating mechanisms, or latching mechanisms, etc. may be used to coact with drive 30 to cause movement of the extension bolt or extension members.) FIG. 15 also depicts a partial cross sectional cut away view of pin 82, showing pin 82 engaged in slot 45 of slide plate 91. Furthermore, FIG. 14 provides a cross sectional view of mortise lock unit 20, showing pin 82 sliding in a slot 47 of deadbolt 22. FIG. 14 also shows pin 82 to be slidable within lock unit 20, pin 82 riding in a slot 27 provided in housing 28. (The location of slot 27 and housing 28 can also be seen in FIG. 24). As depicted in FIGS. 1–4, extension bolt assemblies 34 and 36 are concealed within door 50. Extension bolt assemblies 34 and 36 extend through channels interior to door 50 through which extension bolts 34 and 36 are freely moveable. To extend extension bolts 34 and 36, extension bolt bases 46 and 48 must be extended therewith. Further, to extend extension bolt bases 46 and 48, drive 30 must be rotated in a counterclockwise direction by using handle 62 as discussed above.

Figure 21:
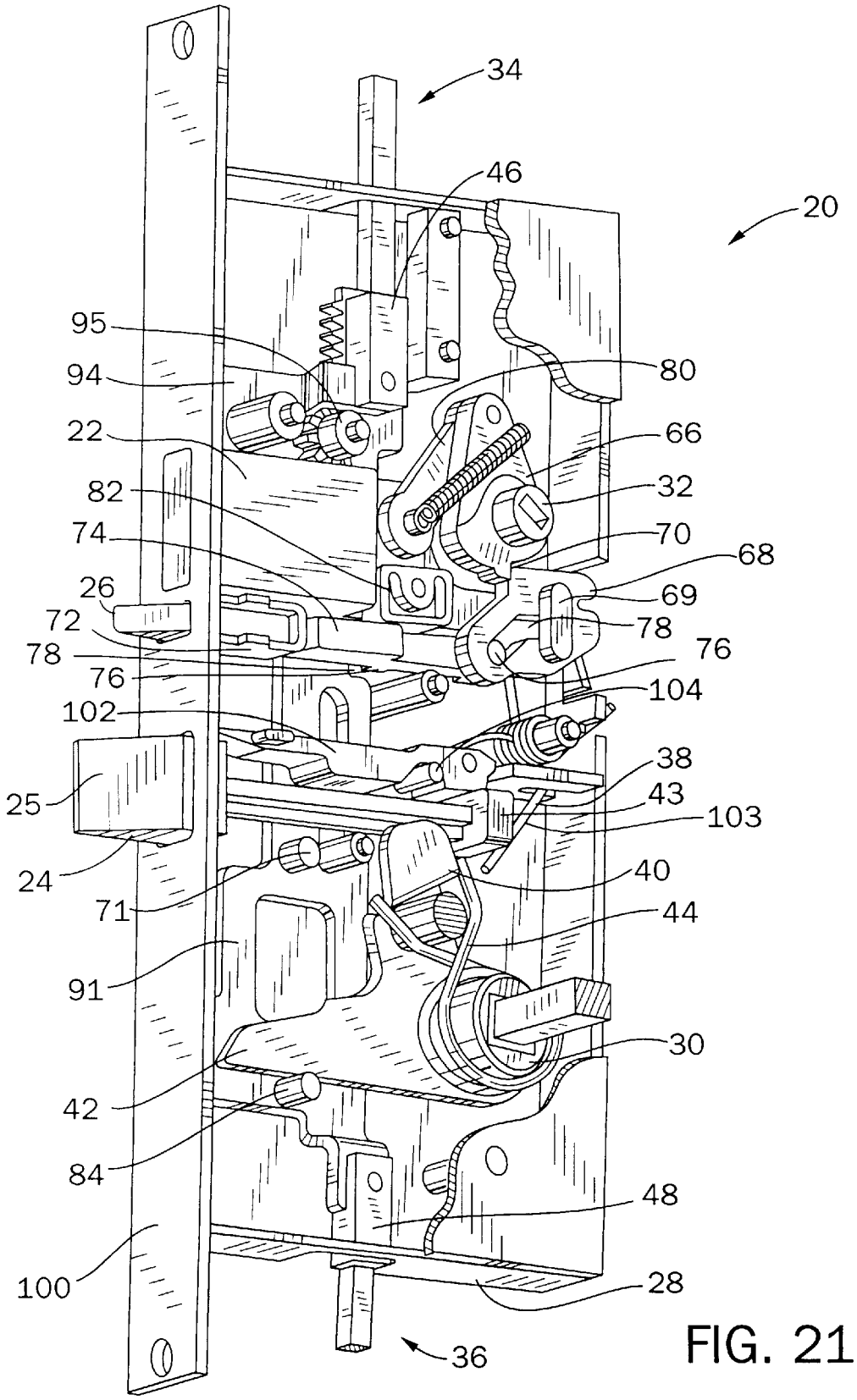
FIG. 21 is a perspective view of the multi-point door lock mortise unit showing the door lock mechanism.

When activation button 26 is extended and extension bolt bases 46 and 48 are retracted, a stop 76 (depicted in FIGS. 9, 10, and 21) on push rod 74 prevents lower slide plate 91 from any substantial movement, and therefore prevents extension bolt bases 46 and 48 from extending through housing 28. When activation button 26 is extended and extension bolt assemblies 34 and 36 are retracted, a counterclockwise rotation to drive 30 will not extend extension bolt bases 46 and 48 because stop 76 engages a groove 78 in lower slide plate 91 thereby preventing any linear upward or downward movement. If extension bolt assemblies 34 and 36 were allowed to move freely without depression of activation button 26, potential damage to door frame 54 or wood work surrounding doors 50 and 52 could result as shutting door 50 could cause extension bolts 35 and 37 to contact door frame 54 and cause damage. For example, as depicted in FIGS. 1–4, if door 52 is closed and door 50 is in the open position, and extension bolts 35 and 37 were extended, closure of door 50 may cause extension bolts 35 and 37 to slam into door frame 54 possibly causing damage to any wood work surrounding door frame 54 (or the locking system). Therefore, activation button 26 is to be depressed before extension bolts 35 and 37 may be extended. When activation button 26 is depressed, stop 76 moves out of slot 78 and slider plate 91 is allowed to move freely along with slider plate 94. (Closure of door 50 causes activation button 26 to be depressed by engagement with door 52.) With door 50 in this closed position, engagement of extension bolts 35 and 37 will more firmly secure door 50 in door frame 54.

In many conventional multi-point door lock systems, operation is not "intuitive" as to the extension bolts and the deadbolt, because the deadbolt is typically coupled to the extension bolt mechanism such that the deadbolt is extended if and only if the extension bolts are extended. According to any preferred embodiment of the present invention, the extension of deadbolt 22 is independent of the extension of extension bolts 35 and 37. Therefore, an operator may choose to extend either deadbolt 22 or extension bolts 35 and 37. Thus, when an operator does not understand how to extend extension bolts 35 and 37 for optimum security, deadbolt 22 may still be extended by the intuitive operation of thumbturn handle 64, when activation button 26 is depressed.

To extend deadbolt 22 without extending extension bolts 35 and 37, an operator first closes door 50. If door 52 is already closed, activation button 26 engages door 52, the engagement depresses activation button 26 into housing 28. As activation button 26 is depressed, rod 74 pushes pin 76 to ride in slot 78. As pin 76 rides in slot 78, thumbturn stop 68 moves in the vertical direction thereby freeing thumbturn link 66 along thumbturn 32 to be rotated and thereby extending deadbolt 22 as earlier described.

Once multi-point door lock unit 20 is in the fully locked position, as depicted in FIG. 8, the door 50 may not be unlocked until deadbolt 22 is first unlocked. In other words, a user is prevented from retracting extension bolt assemblies 34 and 36 or latch 24 until deadbolt 22 is first retracted. Pin 82 that rides in slot 83 of deadbolt 22 also sits in a slot 45 of slide plate 91 thereby preventing slide plate 91 from moving in the vertical direction. If slide plate 91 is prevented from moving in the vertical direction, extension bolt assemblies 34 and 36 are also prevented from moving. Furthermore, if slide plate 91 is prevented from moving, input arm 42 is prevented from engaging latch stop 43 because a pin 71 prevents end 40 of input arm 42 from engaging latch stop 43. A biasing spring 23 retains pin 82 within slot 45 of slide plate 91.

To unlock door 50, an operator first turns thumbturn 32 in a clockwise direction. As deadbolt 22 is retracted into housing 28, end 47 of slot 45 engages pin 82 as depicted in FIGS. 6 and 12–14 and thereby moves pin 82 out of slot 45. In such a position, slide plate 91 is freed to move. Therefore, clockwise rotation of drive 30 causes input arm 42 to engage pin 71. This engagement drives slide plate 91 in the vertical upwards direction causing pinion 95 to rotate in the counterclockwise direction thereby driving slide plate 94 in the vertical downwards direction. Thus, extension bolt assemblies 34 and 36 are retracted into housing 28 thereby unlocking door 50. As input arm 42 drives slide plate 91 in the vertical upward direction, end 40 of input arm 42 engages latch stop 43 thereby causing retraction of latch 24 into housing 28.

Referring again to FIGS. 1–4, it should be noted that it may be preferable to have door lock 20 mounted in door 52 as opposed to door 50. If it is desired to mount door lock 20 in door 52, it would be necessary to install latch 24 (which has a "flat" face or surface and a diagonal face or surface) with its diagonal face turned in the opposite direction compared to the position of door lock 20 when installed in door 50, as depicted in FIGS. 1–4 (so that it is readily guided into its receptacle in the other door or frame but yet may firmly hold against a pulling force once the door is closed).

Referring now to FIG. 16, diagonal surface 25 of latch 24 is depicted. It may be preferable to install latch 24 with diagonal surface 25 facing in the opposite direction, as shown in phantom lines (that is to have latch 24 rotated 180 degrees about an axis that is perpendicular to a face plate 100). FIG. 17 depicts latch 24 in the position shown in FIG. 16. A latch retainer 102 guides latch 24 to slide in a linear horizontal direction. Latch retainer 102 is retained in its guiding position, depicted in FIG. 17, by a biasing spring 103 and a pin 104.

Figure 22:
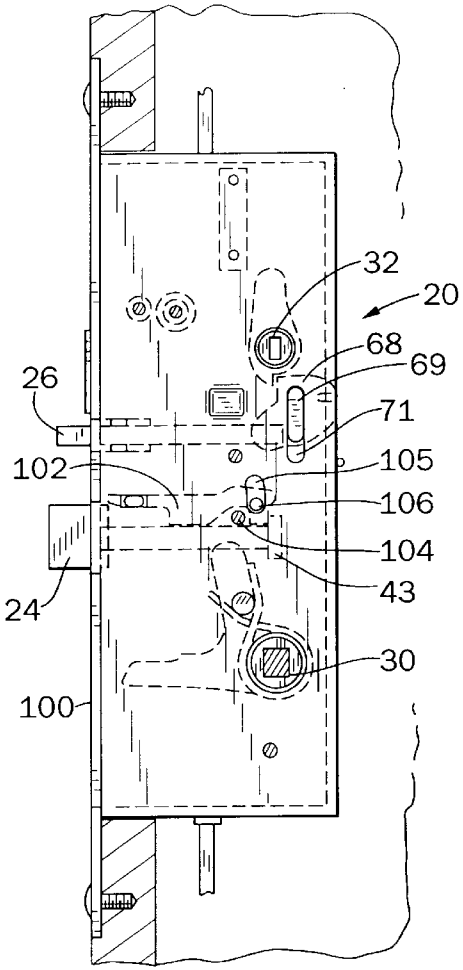
FIG. 22 is a side elevational view of the door lock unit embedded in a door.
Figure 23:
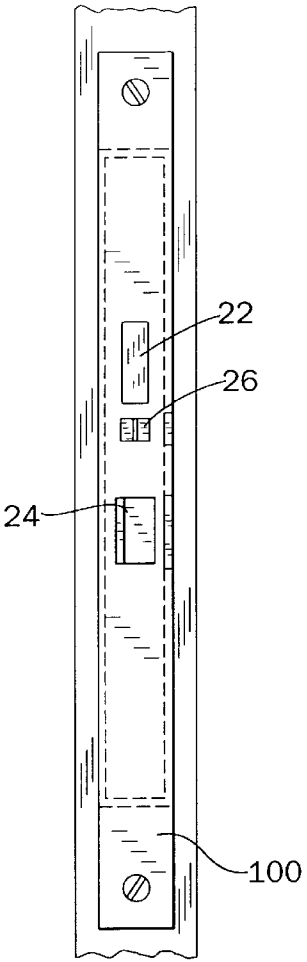
FIG. 23 is an edge elevational view of the door lock unit attached to the edge of a door.

To reorient (or "reverse") latch 24, an operator inserts a tool 106, such as a screwdriver or other suitable tool, into a slot 105. The operator then lifts tool 106 to rotate latch retainer 102 in a direction depicted in FIG. 18 by arrow 108. Once retainer 102 is in the released position depicted in FIG. 18, latch 24 may be extended out of housing 28 in a direction shown by arrow 110 in FIG. 20. Once latch 24 is extended as depicted in FIG. 20, latch 24 can be rotated as depicted by arrow 112 in FIG. 19. The rotation of latch 24 reorients diagonal surface 25 into an alternative position as depicted in FIG. 16, in phantom. After latch 24 is rotated and reoriented in the desired position, latch 24 is reinserted into housing 28 in a direction opposite arrow 110 until latch stop 43 passes end 114 of latch retainer 102. Retaining spring 103 and release from tool 106, causes retainer 102 to return to its initial position, depicted in FIG. 17. As depicted in FIG. 22, retainer 102 can be accessed through slot 105 which is located on one side of the door lock unit 20. (According to an alternative embodiment, an access hole could be placed in an alternative position on housing 28 such that a tool, such as tool 106 could be used to access and manipulate the position of retainer 102, that is to release retainer 102 from its initial position on pin 104; furthermore, other latch reorienting mechanisms may be applied without departing from the spirit and scope of the present invention.)

Figure 25:
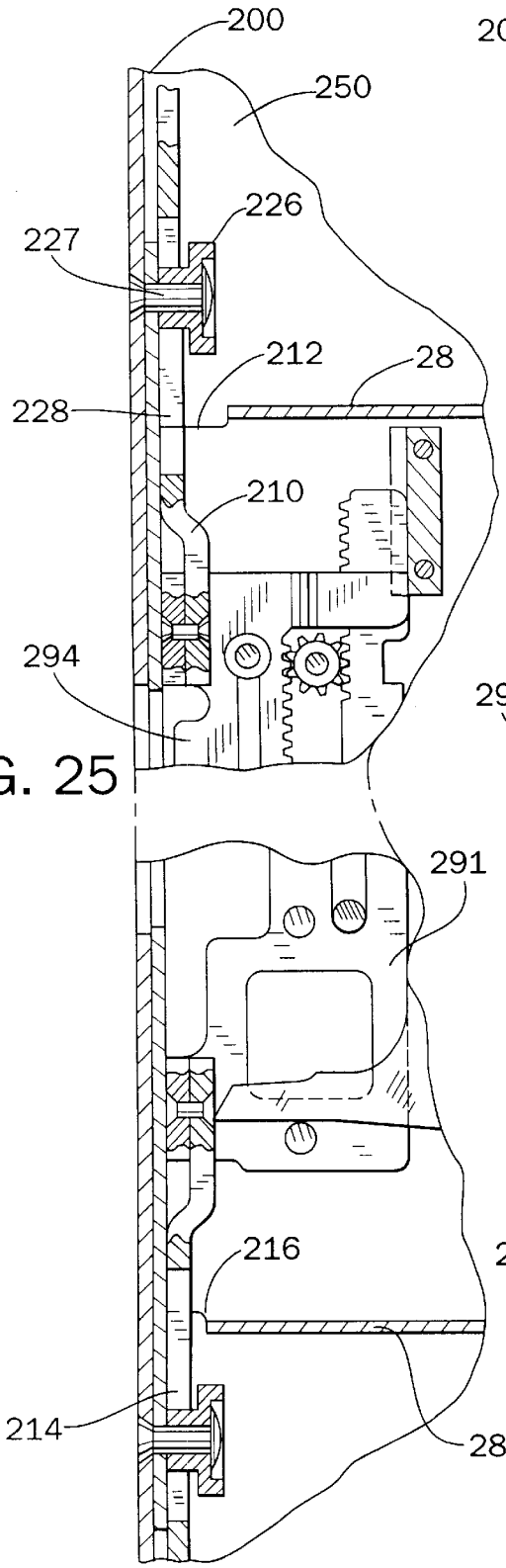
FIG. 25 is a partial cut away elevational view of the multi-point door lock unit depicting the extension bolt assembly to slide plate couplings, the extension bolt assemblies being in the retracted position.
Figure 26:
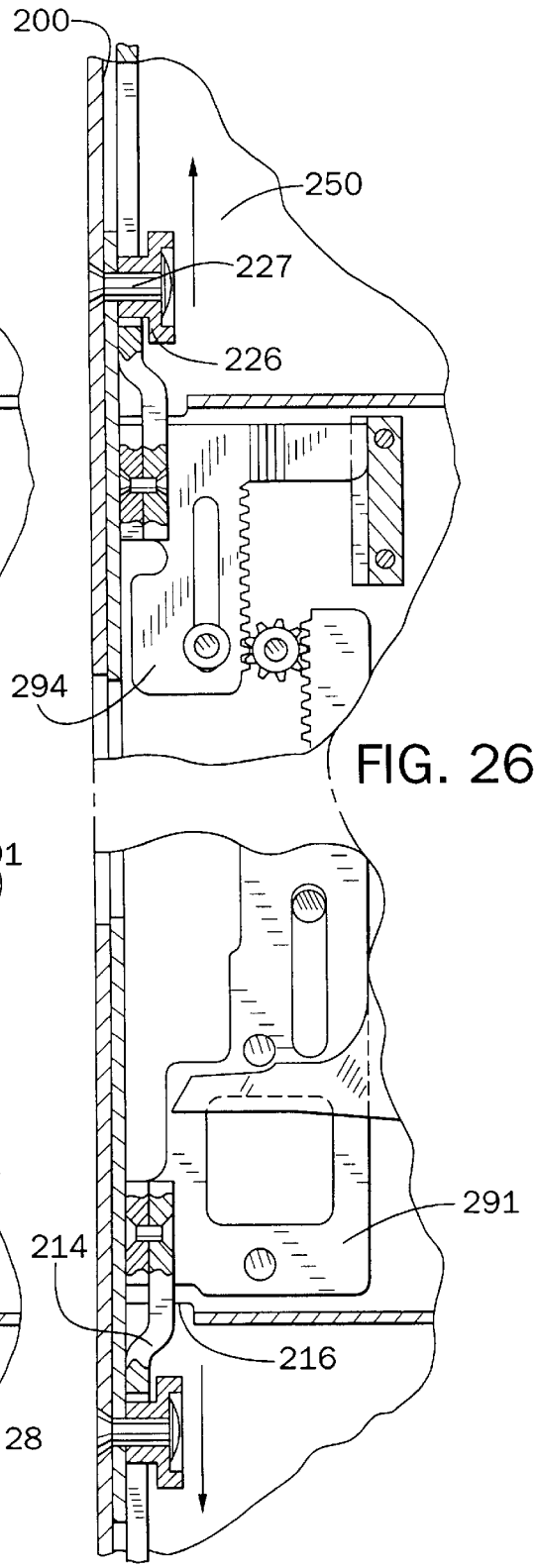
FIG. 26 is a partial elevational cut away view of the multi-point door lock unit showing the extension bolt base to slide plate couplings, the extension bolt bases being in the extended position.
Figure 28:
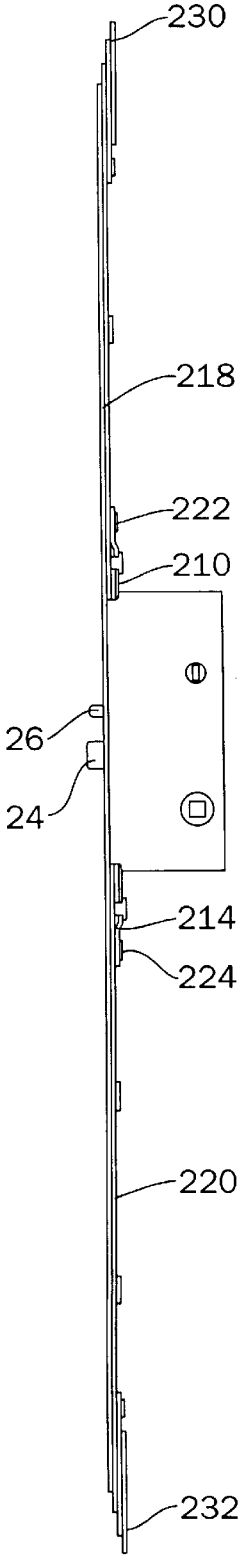
FIG. 28 is a side elevational view of the face plate embodiment of the door lock unit.

According to a preferred embodiment, multi-point door lock 20 is reconfigurable and modular and the extension bolts may be installed to extend through the interior of the door, as depicted in FIGS. 1–4; in an alternative embodiment the extension bolts may be installed to extend along an edge 200 of a door 250, as depicted in FIGS. 25, 26, and 28. As depicted in FIGS. 25 and 26, an extension bolt base 210 extends through a top slot 212 in housing 28. Similarly, an extension bolt base 214 extends through a bottom slot 216 in housing 28. Extension bolt base 210 is coupled to slide plate 294 which is actuated by drive 30. Similarly, extension bolt base 214 is coupled to slide plate 291 which is also actuated by drive 30. As drive 30 is turned in the counterclockwise direction, extension bolt bases 212 and 214 are extended from housing 28, as depicted in FIG. 26.

Figure 29:
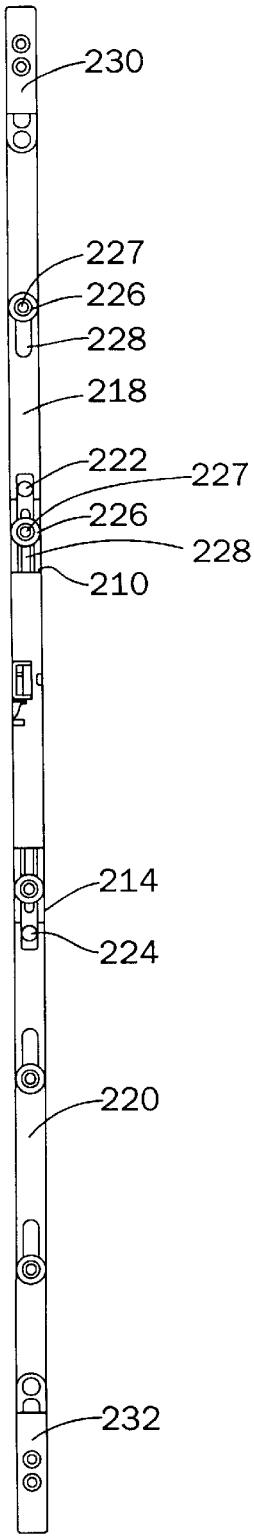
FIG. 29 is a rear elevational view of the face plate embodiment of the door lock unit.

As depicted in FIGS. 28 and 29, extension bolt bases 210 and 214 are coupled to extension assemblies 218 and 220 respectively by pins 222 and 224 respectively. A series of spacer guides 226 have columnar pins 227, running therethrough; the spacer guides 226 ride in elongated slots 228. (Columnar pins 222 may be provided by, for example, appropriate fasteners such as but not limited to bolts, rivets, nails, or screws.)

Figure 27:
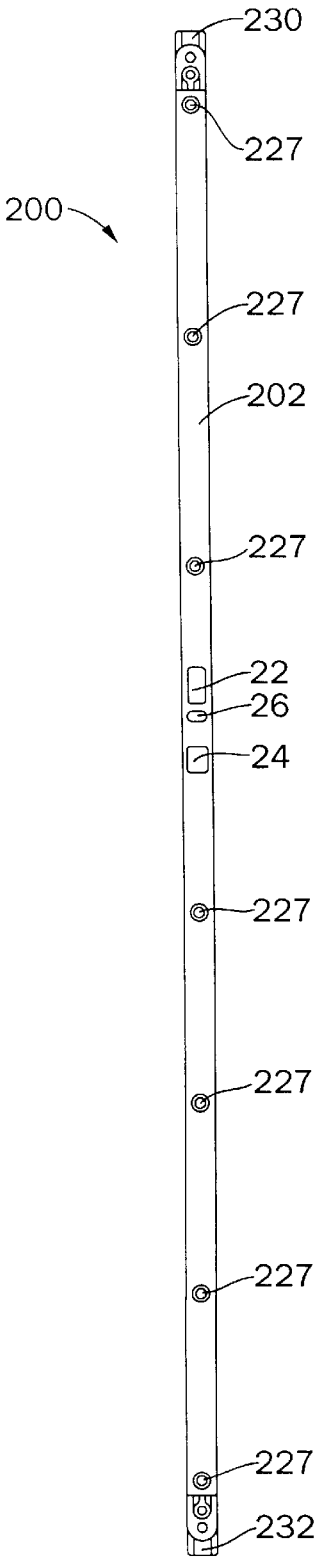
FIG. 27 is a front elevational view of the face plate embodiment of the door lock unit.

Extension assemblies 218 and 220 are coupled to extension bolts 230 and 232 respectively. Extension bolts 230 and 232 extend into the door frame to securely latch door 250 to a door frame, such as door frame 54 as depicted in FIGS. 1–4. FIG. 27 depicts face plate system 200 having a face plate 202. Face plate 202 runs along the edge 201 of door 250.

To install face plate system 200 on a door such as door 250, an operator would form a mortise hole in door 250 having a size and shape that would accommodate insertion of mortise unit 20 therein. Also, an operator would provide a routed groove along edge 201 of door 250 that would accommodate the face plate system 200 such that face plate 202 would reside substantially flush with edge 201 of door 250. When face plate assembly 200 is properly positioned, a plurality of pins 227 (or suitable fasteners) may be used to affix assembly 200 to edge 201 of door 250. Pins 227 would extend into edge 201 of door 250 to fasten assembly 200 thereto.

It should be noted that extension assemblies 218 and 220 may be provided in a variety of lengths to accommodate different door sizes. Further, it should also be noted that a variety of extension bolts 230 and 232 may be attached to the ends of extension assembly 218 and 200 to provide customized output suitable for the application. For example, extension bolts 230 and 232 may be replaced by extension hooks or other locking elements or mechanisms.

According to a particularly preferred embodiment, deadbolt 22 and extension bolts 230 and 232 or extension bolts 35 and 37 will extend linearly a distance of approximately one inch or more (or other shorter distances if needed in alternative embodiments). Multi-point door lock 20 allows extension of the extension bolts 35 and 37 or 230 and 232 and the deadbolt 22 to be at least one inch or more; because of the length of input arm 42 that engages pin 88, extension bolt base 36 is caused to move a distance of at least one inch or more. As slide plate 91 or 291 is moved downwardly by input arm 42 engaging pin 88, slide plate 91 or 291 has teeth that engage a pinion wheel 92. Downward movement of slide plate 91 or 291 causes pinion wheel 92 to rotate in a clockwise direction. The teeth on pinion wheel 92 engage second slide plate 94 or 294 which moves upwardly along with upper extension bolt base 34. Upper extension bolt base 34 runs along a guide 35 to provide linear movement. According to a preferred embodiment, both upper bolt base 34 and lower bolt base 36 move linearly approximately one inch or more in opposite directions as caused by the reversing mechanism, pinion gear 92.

As depicted in FIGS. 1–4, handle 62 actuates drive unit 30. In a preferred embodiment, handle 62 is designed to rotate approximately 30 degrees in each direction and preferably less than 45 degrees, to cause extension of extension bolts 35 and 37 or 230 and 232. When extension bolts 35 and 37 or 230 and 232 have been extended, pin 71, depicted in FIG. 8, rests against input arm 42 thereby providing the user with a positive-locked feel via drive unit 30 and handle 62. For example, with extension bolts locked, a user providing a clockwise rotation to handle 62 will feel resistance from pin 71, the resistance to movement caused by pin 82 riding in slot 45, thereby indicating to the user that the extension bolts are extended. If the extension bolts are not extended and deadbolt 22 is extended, pin 71 is in the position as depicted in FIG. 7 and input arm 42 is not constrained to rotate in the clockwise direction, thereby indicating that the extension bolts are not extended. When extension bolts 35 and 37 or 230 and 232 are extended, clockwise rotation of drive 30 causes input arm 42 to engage pin 71 thereby causing retraction of extension bolts 35 and 37 or 230 and 232 simultaneously, arm 40 engages latch stop 43 thereby simultaneously causing latch 24 to retract into housing 28. Therefore, if deadbolt 22 has already been retracted into housing 28 by rotating thumbturn 32 in the clockwise direction, doors 50 or 250 will be free to swing open.

Figure 30:
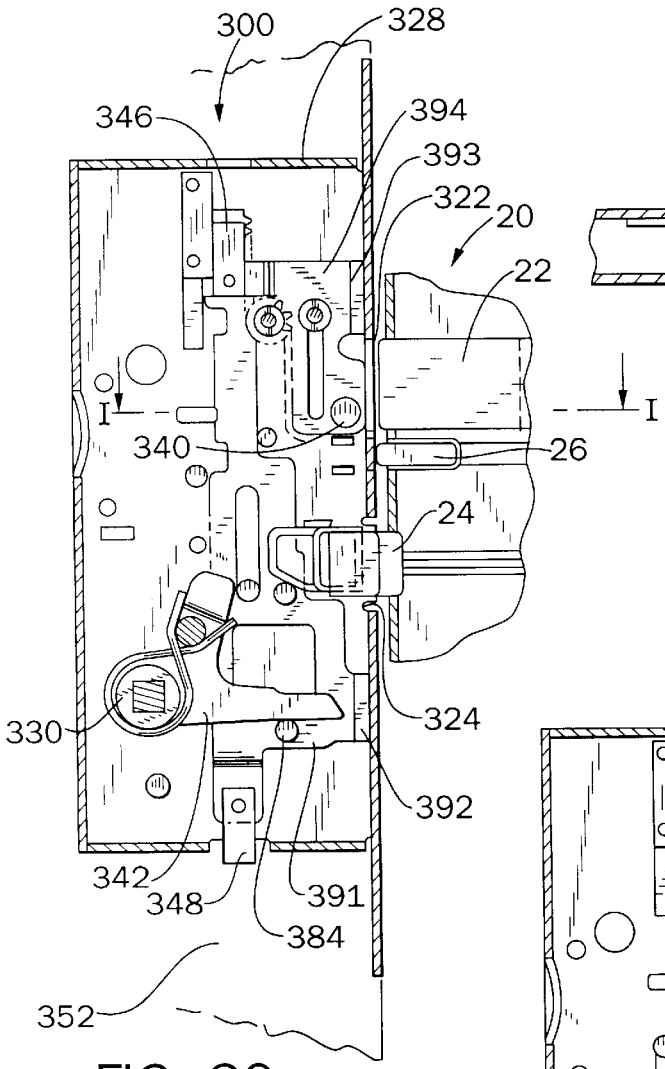
FIG. 30 is an elevational view of the passive multi-point door lock mortise unit having the cover plate removed and showing the mechanical mechanism of the passive door lock.
Figure 31:
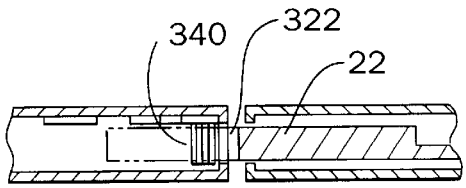
FIG. 31 is a cross sectional view of the passive door lock unit taken across the line I—I of FIG. 30.
Figure 32:
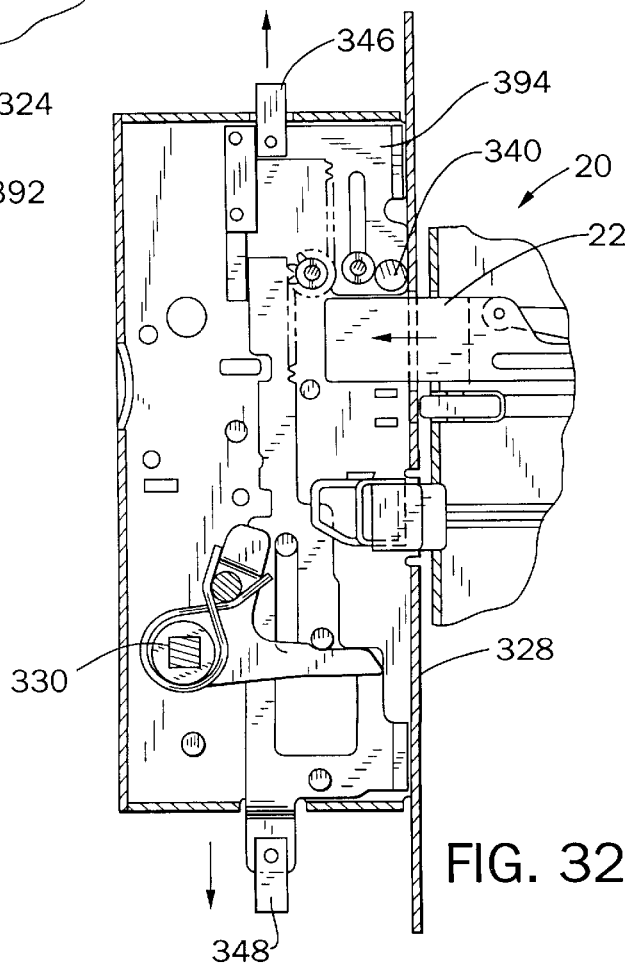
FIG. 32 is an elevational view of the passive door lock unit of FIG. 30 showing the extension bolts in an extended position.

In an alternative embodiment, depicted in FIGS. 30–32, a passive door lock 300 may be used to cooperate with multi-point door lock 20, as described above. As shown in FIG. 30, multi-point door lock 20 is embedded in an active door (such as active door 50, as depicted in FIGS. 1–4). Passive door lock 300 is embedded in a passive door 352 (door 352 being similar to door 52 depicted in FIGS. 1–4). Passive door lock 300 has a housing 328, a deadbolt aperture 322 in housing 328, a latch aperture 324 in housing 328, a drive 330, an input arm 342, a slide plate 391, and a slide plate 394. FIG. 30 depicts passive lock 300 having extension bolt bases 346 and 348 in a retracted position. Extension bolt bases 346 and 348 are configured to be coupled to a set of extension bolt assemblies, the extension bolt assemblies extending through the door and out of the top edge of the door, to lock up and hold door 352 in a locked position, when extension bolt bases 346 and 348 are extended. In an alternative embodiment, extension bolt assemblies may be coupled to slide plates 391 and 394 at positions 392 and 393 respectively, similar to the extension bolt assemblies depicted in FIGS. 25 and 26.

As depicted in FIG. 31, passive lock 300 has a blocker pin 340 that interferes with the movement of deadbolt 22 through deadbolt aperture 322, when passive lock 300 is in a retracted position.

If drive 330 is rotated in the counterclockwise direction, input arm 342 engages a pin 384, causing extension bolt bases 346 and 348 to be extended to the position shown in FIG. 32. As slide plate 394 moves in the upward direction, so does blocking pin 340 such that when extension bolt bases 346 and 348 are in a fully extended position, deadbolt 22 is not restricted from moving through deadbolt aperture 322 and into housing 328, as depicted in FIG. 32. (Other types of lock members may be employed according to alternative embodiments.)

Passive lock 300 therefore requires that the passive door first be placed in a locked state before allowing the active door to be locked using deadbolt 22. This prevents passive door 352 from being unlocked and an operator locking deadbolt 22, whereby forcible entry may be obtained by pulling open both the active and passive doors simultaneously.

Lock 20 (in any preferred or alternative embodiment) may be applied to a variety of configurations, all within the spirit and scope of the present invention. These configurations include, lock 20 in an active door installed in a frame, lock 20 in an active door in a frame with a passive door in a frame, and lock 20 in an active door in a frame with a passive door in a frame with a passive lock.

According to alternative embodiments of the present invention, a variety of passive locks may be applied without departing from the spirit and scope of the present invention. These passive locks may include passive locks that are automatically triggered by locking of the primary door, locks having different extension assembly arrangements, and locks having different locking mechanisms.

According to further alternative embodiments of the present invention, door lock 20 may be embodied without activation button 26 (while still retaining all of the structure functionality that does not depend on activation button 26), without departing from the spirit and scope of the present invention; furthermore, activation button 26 may be viewed as a selectively removable device, without departing from the spirit and scope of the present invention.

Although only a few exemplary embodiments of this invention have been described in detail above, those skilled in the art will readily appreciate that many modifications are possible in the exemplary embodiments without materially departing from the novel teachings and advantages of this invention. For example, various input devices and/or different handle configurations may be coupled to the door lock, various alternative mechanisms may be used to provide locking action, different extension bolt and/or deadbolt configurations or hooks or latches may be used, members and elements may be coupled (or may co-act) directly or indirectly (e.g. through other intermediate links or structures), and the door lock may be applied to different door arrangements or configurations. Accordingly, all such modifications are intended to be included within the scope of the invention as defined in the following claims. Furthermore, a variety of mechanisms may be applied to carry out the functions of the door lock. Although members and elements may be shown as directly or indirectly coupled in the exemplary embodiments, the present invention should not be considered to be limited to such couplings (e.g. such couplings may be direct or indirect) within the spirit and scope of the present invention.

The method of operation of the lock according to preferred and alternative embodiments may be performed in various steps; any omissions or additions of steps to those steps disclosed, or any departure from the order or sequence of steps recited, should be considered to fit within the spirit and scope of the invention.

In the claims, each means-plus-function clause is intended to cover the structures described herein as performing the recited function and not only structural equivalents but also equivalent structures.

Other substitutions, modifications, changes, and omissions may be made in the design, size or proportion, operating conditions, and arrangement of the preferred embodiments without departing from the spirit of the invention as described in the appended claims.

What is claimed is:

1. A locking system, comprising:

a base lock member moveable between a first position and a second position;

a first input device;

an activation device; and at least one secondary lock member having a first secondary lock position and a second secondary lock position, wherein the base lock member is moveable between a first position and a second position in response to actuation of the first input device, and the base lock member is prevented from moving from the first position to the second position when the activation device is not activated and the at least one secondary lock member is moveable between the first secondary lock position and the second secondary lock position in response to actuation of the first input device.

2. The locking system of claim 1 wherein the at least one secondary lock member is prevented from moving from a first position to a second position when the activation device is not activated.

3. The locking system of claim 2 further comprising:

a latch, wherein the latch moves in response to actuation of the first input device.

4. The locking system of claim 1 wherein the second position of the base lock member is a fully extended position.

5. The locking system of claim 1 wherein the second secondary lock position of the at least one secondary lock member is a fully extended position.

6. The locking system of claim 1 wherein the base lock member is a deadbolt.

7. The locking system of claim 1 wherein the at least one secondary lock member is an extension bolt.

8. The locking system of claim 1 wherein the at least one secondary lock member is a deadbolt.

9. The locking system of claim 1 wherein the first input device is a thumbturn.

10. The locking system of claim 1 wherein the first input device is a handle.

11. The locking system of claim 1 wherein the activation device is a button.

12. A locking system, comprising:

a base lock member moveable between a first position and a second position;

a first input device;

an activation device;

at least one secondary lock member having a first secondary lock position and a second secondary lock position; and a second input device, wherein the base lock member is moveable between a first position and a second position in response to actuation of the first input device, and the base lock member is prevented from moving from the first position to the second position when the activation device is not activated and the at least one secondary lock member is moveable between the first secondary lock position and the second secondary lock position in response to actuation of the second input device.

13. The locking system of claim 12 further comprising:

a passive lock device, the passive lock device including at least one passive lock member, moveable from a first passive lock position to a second passive lock position.

14. The locking system of claim 13 wherein the at least one passive lock member moves in response to movement of the base lock member.

15. The locking system of claim 14 wherein the passive lock device further comprises:

a passive input device, wherein the at least one passive lock member moves in response to actuation of the passive input device.

16. The locking system of claim 15 wherein the passive lock prevents movement of the base lock member from the first position to the second position when the at least one passive lock member is in the first passive lock position.

17. The locking system of claim 16 wherein the passive input device is prevented from substantial movement caused by interaction with the base lock member, when the base lock member is in the second position and the at least one passive lock member is in the second passive lock position.

18. The locking system of claim 12 wherein the at least one secondary lock member is prevented from moving from the first secondary lock position to the second secondary lock position when the activation device is not activated.

19. The locking system of claim 18 wherein the at least one secondary lock member is prevented from substantial movement from the second secondary lock position when the base lock member is in the second secondary lock position.

20. The locking system of claim 19 wherein the locking system provides positive tactile indication that the base lock member and the at least one secondary lock members are both in the second position and the second secondary lock position, respectively.

21. The locking system of claim 19 wherein the second input device provides a positive indication, to an operator, that both the base lock member and the at least one secondary lock member are in the second position and the second secondary lock position, respectively.

22. The locking system of claim 21 further comprising:

a latch moveable from a first latch position to a second latch position.

23. The locking system of claim 22 wherein the latch is moveable in response to actuation of the first input device.

24. The locking system of claim 22 wherein the latch is moveable in response to actuation of the second input device.

25. The locking system of claim 12 wherein the second input device is a handle.

26. A locking system comprising:

a base lock member moveable between an open position and a fully locked position;

at least one secondary lock member moveable between an open position and a fully locked position;

a first input device adapted to coact with at least one of the base lock member and the at least one secondary lock member, a second input device; and an activation device, the activation device preventing substantial movement of the at least one secondary lock member from the open position when the activation device is not activated, wherein the movement of the base lock member, to the fully locked position, is selectively and sequentially independent of the movement of the at least one secondary lock member to the fully locked position and the at least one secondary lock member is moveable between an open position and a fully locked position in response to actuation of the second input device and the activation device prevents substantial movement of the at least one secondary lock member from the open position when the activation device is not activated.

27. The locking system of claim 26 wherein the secondary lock member is prevented from substantial movement when the base lock member is in a fully locked position and the at least one secondary lock member is in a fully locked position.

28. The locking system of claim 27 further comprising:

a latch, wherein the latch moves in response to actuation of the first input device.

29. The locking system of claim 28 wherein the latch moves in response to actuation of the second input device.

30. The locking system of claim 29 wherein the orientation of the latch is selectively reversible.

31. The locking system of claim 26 wherein the second input device provides a positive indication that the base lock member and the at least one secondary lock member are in the fully locked position.

32. The locking system of claim 31 wherein the positive indication is a tactile indication.

33. The locking system of claim 31 further comprising:

a latch, wherein the latch moves in response to actuation of one of the first input device and the second input device.

34. The locking system of claim 26 wherein the base lock member is a deadbolt.

35. The locking system of claim 26 wherein the at least one secondary lock member is an extension bolt.

36. The locking system of claim 26 wherein the at least one secondary lock member is a deadbolt.

37. The locking system of claim 26 wherein the first input device is a thumbturn.

38. The locking system of claim 26 wherein the first input device is a handle.

39. The locking system of claim 26 wherein the second input device is a handle.

40. The locking system of claim 26 wherein the activation device is a button.

41. A door lock assembly for use in locking a door, the door lock assembly comprising:

a housing configured to be inserted into an aperture in a door;

a latch extendable from the housing;

a first lock member extendable from the housing;

a first input device mounted adjacent the housing, the first input device configured to affect movement of the first lock member;

at least one second lock member moveable relative to the housing;

a second input device mounted adjacent the housing and configured to selectively actuate one of the at least one second lock member, the latch, and the at least one second lock member and the latch; and an activation device that allows selective actuation of one of the first lock member independent of the at least one second lock member, and the at least one second lock member and the first lock member are actuatable independent of each other, when the activation device is activated.

42. The door lock assembly of claim 41 wherein the latch is rotatable so as to be reconfigurable for one of a left-handed door and a right-handed door.

43. The door lock of claim 41 wherein the first lock member can be extended and retracted from the housing, independent of movement of the at least one second lock member.

44. The door lock assembly of claim 41 further comprising at least one extension member coupled to the at least one second lock member.

45. The door lock assembly of claim 44 wherein each of the at least one second lock member and the at least one extension member are integrated into a single extension member unit.

46. The door lock assembly of claim 44 wherein the at least one extension member extends through at least one second lock member aperture, the at least one second lock member aperture configured to be extendable through the interior of a door.

47. The door lock assembly of claim 44 wherein the at least one extension member may be coupled to the at least one second lock member in at least two different positions, the at least two different positions of the at least one second lock member defining at least two different configurations.

48. The door lock assembly of claim 41 wherein the activation device may be used with one of a left-handed door and a right-handed door.

49. The door lock assembly of claim 41 wherein the activation device is removable such that the at least one second lock member and the first lock member may be actuated without the use of the activation device, when the activation device is removed.

50. The door lock assembly of claim 41 wherein the second input device must be rotated less than forty-five (45) degrees to fully actuate at least one of the latch and the at least one second lock member.

51. The door lock assembly of claim 41 wherein the second input device is prevented from rotation in one direction when the at least one second lock member is extended and the first lock member is extended.

52. The door lock assembly of claim 41 wherein the at least one second lock member and the first lock member each move linearly at least one (1) inch.

53. The door lock assembly of claim 41 wherein the at least one second lock member includes a first extension member base and a second extension member base, the second extension member base coacting with the second input device and the first extension member base coacting with the second extension member base by a motion reversing mechanism.

54. The door lock assembly of claim 41 wherein the first lock member and the at least one second lock member are prevented from being extended when the activation device is extended.

55. A lock assembly for securing a door in a door frame, the door having a top edge, a bottom edge opposite the top edge, a first edge and a second edge opposite the first edge, the door being movably coupled to the frame, the lock assembly comprising:

a housing configured to be inserted into a lock aperture in a door;

a latch moveable in the housing, the latch configured to be located along the first edge of a door;

a deadbolt moveable in the housing, the deadbolt configured to be located along the first side edge of a door;

a thumbturn rotatably mounted adjacent the housing, the thumbturn configured to affect movement of the deadbolt;

a first lock member moveable relative to the housing;

a second lock member moveable relative to the housing; and an activation device that allows one of selective actuation of the deadbolt independent of the first and second lock members, the first and second lock members and the deadbolt being actuatable independent of each other, and the first and second lock members and the deadbolt being actuatable dependent with each other, when the activation device is activated.

56. The lock assembly of claim 55 wherein the thumbturn affects movement of the first lock member, the second lock member, and the deadbolt.

57. The lock assembly of claim 55 further comprising:

a device rotatably mounted adjacent the housing and configured to selectively actuate the first and second lock members and the latch.

58. The lock assembly of claim 55 further comprising:

a first extension member detachably coupled to a first lock member; and a second extension member detachably coupled to a second lock member, wherein the first extension member and the second extension member are moveable with the first lock member and the second lock member.

59. The lock assembly of claim 58 wherein the first extension member is configured to be extendable through a first extension aperture in a door the first extension aperture extending from a top edge of a door to a lock aperture and the second extension member is configured to be extendable through a second extension aperture in a door the second extension aperture extending from a bottom edge of a door to a lock aperture.

60. The lock assembly of claim 58 further comprising:

a first edge plate configured to be coupled to a first edge of a door and substantially concealing the first extension member from view; and a second edge plate configured to be coupled to a first edge of a door and substantially concealing the second extension member from view, wherein the first extension member is slidably coupled to the first edge plate and is configured to be extendable beyond a first edge of a door by actuation of the first lock member and the second extension member is slidably coupled to the second edge plate and is configured to be extendable beyond a first edge of a door by actuation of the second lock member.

61. The door lock assembly of claim 58 wherein the second lock member coacts with a drive and the first lock member coacts with the second lock member by a motion reversing mechanism.

62. The door lock assembly of claim 55 wherein the latch is selectively turnable so as to be reconfigurable for one of a left-handed door and a right-handed door.

63. The door lock of claim 55 wherein the deadbolt can be extended independent of movement of the first and second lock members.

64. The door lock assembly of claim 55 wherein the activation device is useable with one of a left-handed door and a right-handed door.

65. The door lock assembly of claim 55 wherein the activation device is removable such that the first and second lock members and the deadbolt may be actuated without the use of the activation button.

66. The door lock assembly of claim 55 wherein a drive must be rotated less than forty-five (45) degrees to fully actuate the latch and the first and second extension members.

67. The door lock assembly of claim 55 wherein a drive is prevented from rotation in one direction when the deadbolt is extended and the first and second lock members are extended.

68. The door lock assembly of claim 55 wherein the first and second lock members and the deadbolt each move linearly at least one (1) inch.

69. The lock assembly of claim 55 wherein the latch is substantially made of a polyester resin.

70. The lock assembly of claim 55 wherein the thumbturn affects substantially linear movement of the deadbolt.

71. The lock assembly of claim 55 further comprising:

a passive lock configured to be mounted on a second door in a door frame.

72. The lock assembly of claim 71 wherein the passive lock includes at least one extension member configured to secure a passive door to a door frame when the extension member is extended; and a blocking member preventing extension of the deadbolt when the at least one extension member of the passive lock is retracted.

73. A lock assembly for securing a door in a door frame, the door having a first edge and a second edge opposite the first edge, the door being movably coupled to the frame, the lock assembly comprising:

a housing configured to be inserted into an aperture in a door;

a latch moveable in the housing, the latch configured to be located along the first edge of a door;

a deadbolt moveable in the housing, the deadbolt configured to be located along the first edge of a door;

a first input device mounted adjacent the housing, the first input device configured to affect movement of the deadbolt;

at least one lock member moveable within the housing;

a second input device mounted adjacent the housing and configured to selectively actuate one of the at least one lock member, the latch, and the at least one lock member and the latch; and wherein the deadbolt and the at least one lock member may be selectively extended independently of one another.

74. The lock assembly of claim 73 wherein the deadbolt and the at least one lock member may be selectively fully extended independently of one another.

75. The lock assembly of claim 73 wherein the substantial movement of the second input device is prevented when the deadbolt and the at least one lock member is substantially extended.

76. The lock assembly of claim 75 wherein the deadbolt and the at least one lock member may be selectively fully extended independently of one another in any sequence.

77. A lock assembly for securing a door to a door frame, the door having a first edge and a second edge opposite the first edge, the door being movably coupled to the frame, the lock assembly comprising:

a housing configured to be inserted into an aperture in a door;

a latch moveable in the housing, the latch configured to be located along the first edge of a door;

a deadbolt moveable in the housing, the deadbolt configured to be located along the first edge of a door;

a first input device mounted adjacent the housing, the first input device configured to affect movement of the deadbolt;

a second input device mounted adjacent the housing and configured to selectively actuate the latch; and an activation device, that allows actuation of the deadbolt when the activation device is activated;

wherein substantial movement of the second input device is prevented when the deadbolt is substantially extended.

78. In a lock assembly for securing a door in a door frame, the door having a first edge and a second edge opposite the first edge, the door being movably coupled to the frame, the lock assembly comprising:

a housing configured to be inserted into an aperture in a door;

a latch moveable in the housing, the latch configured to be located along the first edge of a door;

a deadbolt moveable in the housing, the deadbolt configured to be located along the first edge of a door;

a thumbturn rotatably mounted adjacent the housing and coupled to the deadbolt, the thumbturn affecting movement of the deadbolt;

at least one secondary lock member moveable relative to the housing;

a drive rotatably mounted adjacent the housing and configured to selectively actuate the at least one secondary lock member and the latch; and the improvement comprising:

an activation device that allows one of selective actuation of the deadbolt independent of the at least one secondary lock member, the at least one secondary lock member and the deadbolt being actuatable independent of each other, when the activation device is depressed.

79. A door lock assembly for securing a door in a door frame, the door lock assembly comprising:

a housing configured to be inserted into an aperture in a door;

a latch extendable from the housing;

a first lock member extendable from the housing;

a second lock member moveable relative to the housing;

a drive means to selectively actuate one of the first lock member, the second lock member, and the first lock member and the second lock member; and a lock out means that prevents actuation of one of the first lock member independent of the second lock member, and the first lock member and the second lock member independent of each other, when the lock out means is not activated.

* * * * *

US006209931C1

(12) EX PARTE REEXAMINATION CERTIFICATE (9921st)

United States Patent
Von Stoutenborough et al.

(10) Number: US 6,209,931 C1
(45) Certificate Issued: Nov. 6, 2013

(54) MULTI-POINT DOOR LOCKING SYSTEM

(75) Inventors: Eric Von Stoutenborough, Winnebago, IL (US); Stephen Mark Purcell, Loves Park, IL (US); Michael David Smith, Winnebago, IL (US); Thomas Michael Wright, Rockford, IL (US)

(73) Assignee: Newell Operating Company, Freeport, IL (US)

Reexamination Request:
No. 90/012,412, Jul. 31, 2012

Reexamination Certificate for:

| | |
|---|---|
| Patent No.: | **6,209,931** |
| Issued: | **Apr. 3, 2001** |
| Appl. No.: | **09/255,297** |
| Filed: | **Feb. 22, 1999** |

(51) Int. Cl.

| | |
|---|---|
| ***E05C 9/04*** | (2006.01) |
| ***E05C 9/00*** | (2006.01) |
| ***E05C 1/06*** | (2006.01) |
| ***E05C 1/12*** | (2006.01) |
| *E05B 59/00* | (2006.01) |
| *E05B 63/00* | (2006.01) |
| *E05C 7/04* | (2006.01) |
| *E05B 63/18* | (2006.01) |
| *E05C 7/00* | (2006.01) |
| *E05B 63/04* | (2006.01) |

(52) U.S. Cl.
USPC ..... 292/160

(58) Field of Classification Search
None
See application file for complete search history.

(56) References Cited

To view the complete listing of prior art documents cited during the proceeding for Reexamination Control Number 90/012,412, please refer to the USPTO's public Patent Application Information Retrieval (PAIR) system under the Display References tab.

*Primary Examiner* — Patricia Engle

(57) ABSTRACT

A multi-point door lock unit is disclosed. In one preferred form the door lock is for use with a hinged or swinging door. The door lock unit has a latch, a deadbolt, and extension bolts extendable away from the door. The door lock may be used with a double door entry whereby one door is an active door having the lock unit and a second door is a passive door having a passive lock unit. Further, the door lock unit has an activation button that prevents extension of the deadbolt and the extension bolts unless the activation button is depressed.

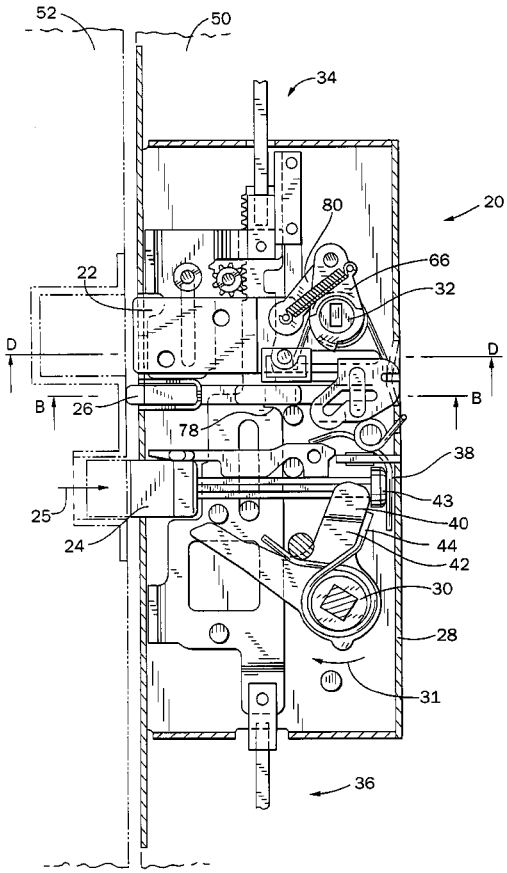

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-11, 26-54 and 78 is confirmed.

Claims 55-72, 77 and 79 are cancelled.

Claims 12 and 73 are determined to be patentable as amended.

Claims 13-25 and 74-76, dependent on an amended claim, are determined to be patentable.

12. A locking system, comprising:

a base lock member moveable between a first position and a second position;

a first input device;

an activation device;

at least one secondary lock member having a first secondary lock position and a second secondary lock position; and a second input device, wherein the base lock member is moveable between a first position and a second position in response to actuation of the first input device, [and the base lock member is prevented from moving from the first position to the second position when the activation device is not activated and] the at least one secondary lock member is moveable between the first secondary lock position and the second secondary lock position in response to actuation of the second input device*, the activation device separately prevents the base lock member and the at least one secondary lock member from actuation when the activation device is not activated, and allows the independent actuation of the base lock member and at least one secondary lock member when the activation device is activated.*

73. A lock assembly for securing a *primary door and a secondary* door in a door frame, the *primary door and secondary* door having a first edge and a second edge opposite the first edge, the *primary* door being movably coupled to the frame, the lock assembly comprising:

a housing configured to be inserted into an aperture in [a] *the primary* door;

a latch moveable in the housing, the latch configured to be located along the first edge of [a] *the primary* door;

a deadbolt moveable in the housing, the deadbolt configured to be located along the first edge of [a] *the primary* door;

a first input device mounted adjacent the housing, the first input device configured to affect movement of the deadbolt;

at least one lock member moveable within the housing;

a second input device mounted adjacent the housing and configured to selectively actuate one of the at least one lock member, the latch, and the at least one lock member and the latch; and

*an activation device,* wherein *the deadbolt and the at least one lock member are separately prevented from movement when the activation device is not activated and* the deadbolt and the at least one lock member may be selectively extended independently of one another *when the activation device is activated.*

* * * * *